US011286078B2

(12) United States Patent
Katayama

(10) Patent No.: US 11,286,078 B2
(45) Date of Patent: Mar. 29, 2022

(54) PRINTER

(71) Applicant: SATO HOLDINGS KABUSHIKI KAISHA, Tokyo (JP)

(72) Inventor: Tamotsu Katayama, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 362 days.

(21) Appl. No.: 16/074,652

(22) PCT Filed: Feb. 15, 2017

(86) PCT No.: PCT/JP2017/005423
§ 371 (c)(1),
(2) Date: Aug. 1, 2018

(87) PCT Pub. No.: WO2017/150184
PCT Pub. Date: Sep. 8, 2017

(65) Prior Publication Data

US 2019/0039388 A1 Feb. 7, 2019

(30) Foreign Application Priority Data

Mar. 4, 2016 (JP) ..... JP2016-042590

(51) Int. Cl.
*B65C 9/18* (2006.01)
*B41J 2/32* (2006.01)
(Continued)

(52) U.S. Cl.
CPC ..... *B65C 9/1865* (2013.01); *B41J 2/32* (2013.01); *B41J 3/4075* (2013.01); *B41J 11/04* (2013.01);
(Continued)

(58) Field of Classification Search
CPC ..... B41J 3/4075; B65C 9/1865
See application file for complete search history.

(56) References Cited

U.S. PATENT DOCUMENTS 6,530,705 B1 3/2003 Petteruti et al.
2004/0079490 A1 4/2004 Ito
(Continued)

FOREIGN PATENT DOCUMENTS

CN 1733555 A 2/2006
EP 1 619 034 A1 1/2006
(Continued)

OTHER PUBLICATIONS

Chinese Office Action, Application No. 201780010256.2, dated Jun. 24, 2019, 6 pages.
Extended European Search Report, dated Feb. 11, 2019, 13 pages.

*Primary Examiner* — Michael N Orlando
*Assistant Examiner* — John Blades
(74) *Attorney, Agent, or Firm* — Foley & Lardner LLP

(57) ABSTRACT

A printer capable of separating a print medium from a mount and ejecting the print medium includes: a platen roller configured to feed, along a feeding path, a mount to which a print medium temporarily adheres; a print head configured to print on the print medium, the print head being opposed to the platen roller; a driven roller that is movable between a first position and a second position different from the first position; a separation member configured to separate a feeding path of the mount and a feeding path of the print medium; and a looseness prevention mechanism configured to prevent the mount from being loose while the driven roller moves from the second feed position to the first feed position. The first position is a position where the driven roller is opposed to the platen roller. The driven roller is configured to be driven by the platen roller while coming in contact with the mount.

16 Claims, 31 Drawing Sheets

(51) Int. Cl.

| | |
|---|---|
| ***B65H 41/00*** | (2006.01) |
| ***B41J 3/407*** | (2006.01) |
| ***B41J 11/04*** | (2006.01) |
| ***B41J 15/04*** | (2006.01) |
| ***B41J 29/13*** | (2006.01) |

(52) U.S. Cl.
CPC ..... *B41J 15/042* (2013.01); *B41J 29/13* (2013.01); *B65H 41/00* (2013.01)

(56) References Cited

U.S. PATENT DOCUMENTS

| | | | |
|---|---|---|---|
| 2006/0039737 | A1 | 2/2006 | Takami et al. |
| 2011/0214820 | A1 | 9/2011 | Sato |
| 2015/0083040 | A1 | 3/2015 | Sato |
| 2017/0021649 | A1 | 1/2017 | Hirose |

FOREIGN PATENT DOCUMENTS

| | | | | | |
|---|---|---|---|---|---|
| EP | 1 679 198 | A2 | | 7/2006 | |
| JP | 3017440 | U | | 10/1995 | |
| JP | 2002-284429 | | * | 3/2002 | ..... B65H 35/07 |
| JP | 2004-115041 | A | | 4/2004 | |
| JP | 2007-076721 | A | | 3/2007 | |
| JP | 2010-058515 | A | | 3/2010 | |
| JP | 2011-184062 | A | | 9/2011 | |
| JP | 2015-208953 | A | | 11/2015 | |

* cited by examiner

PRINTER

TECHNICAL FIELD

The present invention relates to a printer that is capable of separating a print medium from a mount and ejecting the same.

BACKGROUND ART

Conventionally, a label printer is operable in either an operation mode (which is called "separation ejection mode" hereinafter) or other mode (which is called "continuous ejection mode" hereinafter). The separation ejection is to separate labels temporarily adhering to a mount from the mount and then eject the same. The continuous ejection is to eject labels without separating the labels from a mount. See Japanese utility model patent 3017440, for example.

A user using a printer in the separation ejection mode sets a separation roller at a given separation ejection position. The user bends a mount at the tip thereof via a separation pin, and then pinches the tip of the mount between a platen roller and the separation roller.

When the plater roller rotates, the mount is fed while being pinched between the platen roller and the separation roller. Predetermined information is printed on a label by a thermal head opposed to the platen roller. The label temporarily adheres to the fed mount.

In the case of the separation ejection mode, the mount is fed in the direction in which the separation roller and the platen roller are pinched. Meanwhile, the label to which printing has been performed is separated from the mount one by one. That is, the feeding path of the mount and the feeding path of the label are separated at the separation pin.

SUMMARY OF THE INVENTION

Problems to be Solved by the Invention

When the separation roller is set at the separation ejection position in the conventional printer, it may happen that the mount becomes loose (that is, the mount does not pass on the shortest path) between a position where the thermal head and the platen roller are opposed and a position where the separation roller and the platen roller are opposed. If the separation roller is set at the separation ejection position with the mount being loose, a trouble may occur.

The present invention aims to provide a printer capable of preventing a mount from being loose when the separation roller is set at the separation ejection position.

Means for Solving the Problems

An embodiment of the present invention is a printer capable of separating a print medium from a mount and ejecting the print medium, the printer including: a platen roller configured to feed, along a feeding path, a mount to which a print medium temporarily adheres; a print head configured to print on the print medium, the print head being opposed to the platen roller; a driven roller that is movable between a first position and a second position different from the first position, the first position being a position where the driven roller is opposed to the platen roller, the driven roller configured to be driven by the platen roller while coming in contact with the mount; a separation member configured to separate a feeding path of the mount and a feeding path of the print medium; and a looseness prevention mechanism configured to prevent the mount from being loose when the driven roller moves from the second feed position to the first feed position.

Effect of the Invention

The printer according to the present invention is capable of preventing a mount from being loose when the separation roller is set at the separation ejection position.

DETAILED DESCRIPTION OF THE INVENTION

Figure 1:
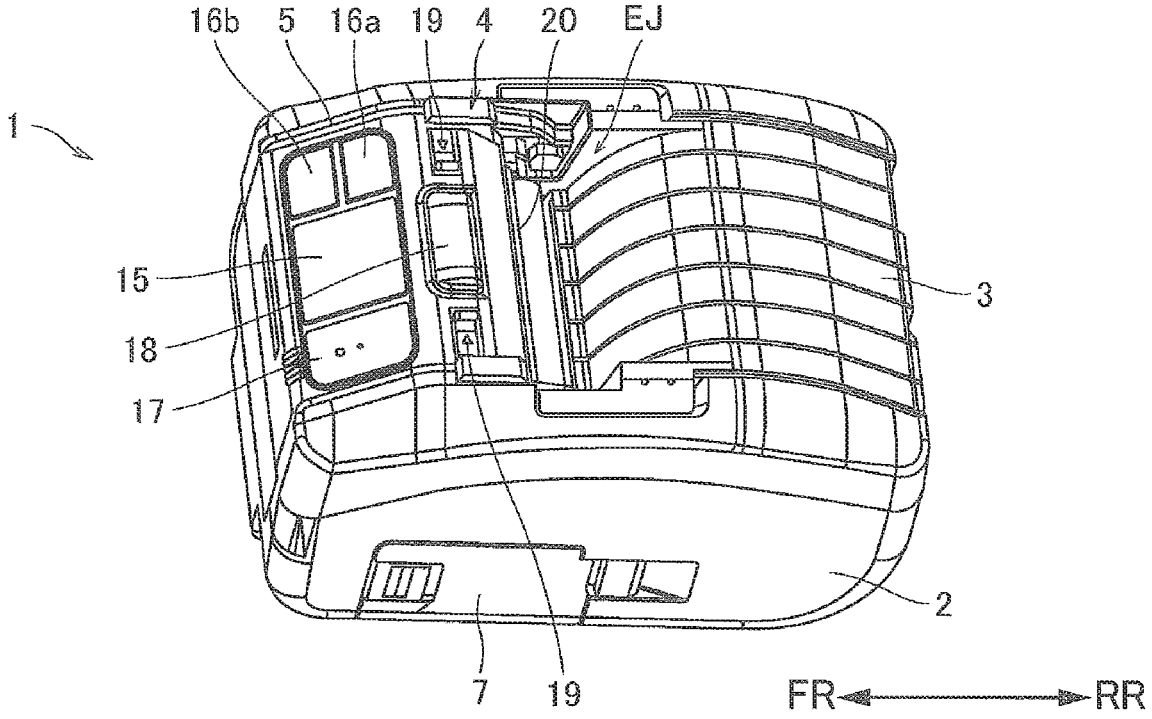
FIG. 1 is an overall perspective view of a printer according to the present embodiment in the continuous ejection mode.

The following describes one embodiment of the present invention in details with reference to the drawings. In the drawings to describe the embodiment, the same reference numerals are basically assigned to the corresponding elements, and the repeated descriptions therefor are omitted.

(1) CONFIGURATION OF THE PRINTER

Figure 2:
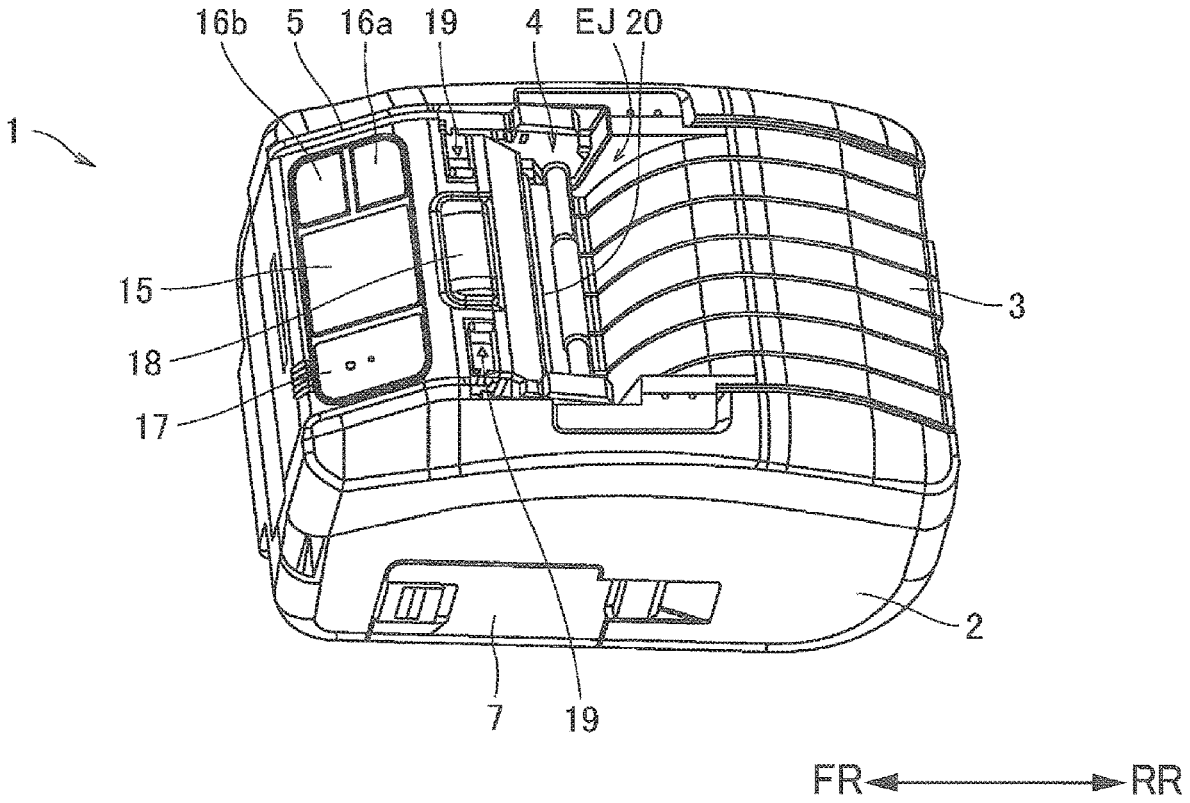
FIG. 2 is an overall perspective view of a printer according to the present embodiment in the separation ejection mode.
Figure 3:
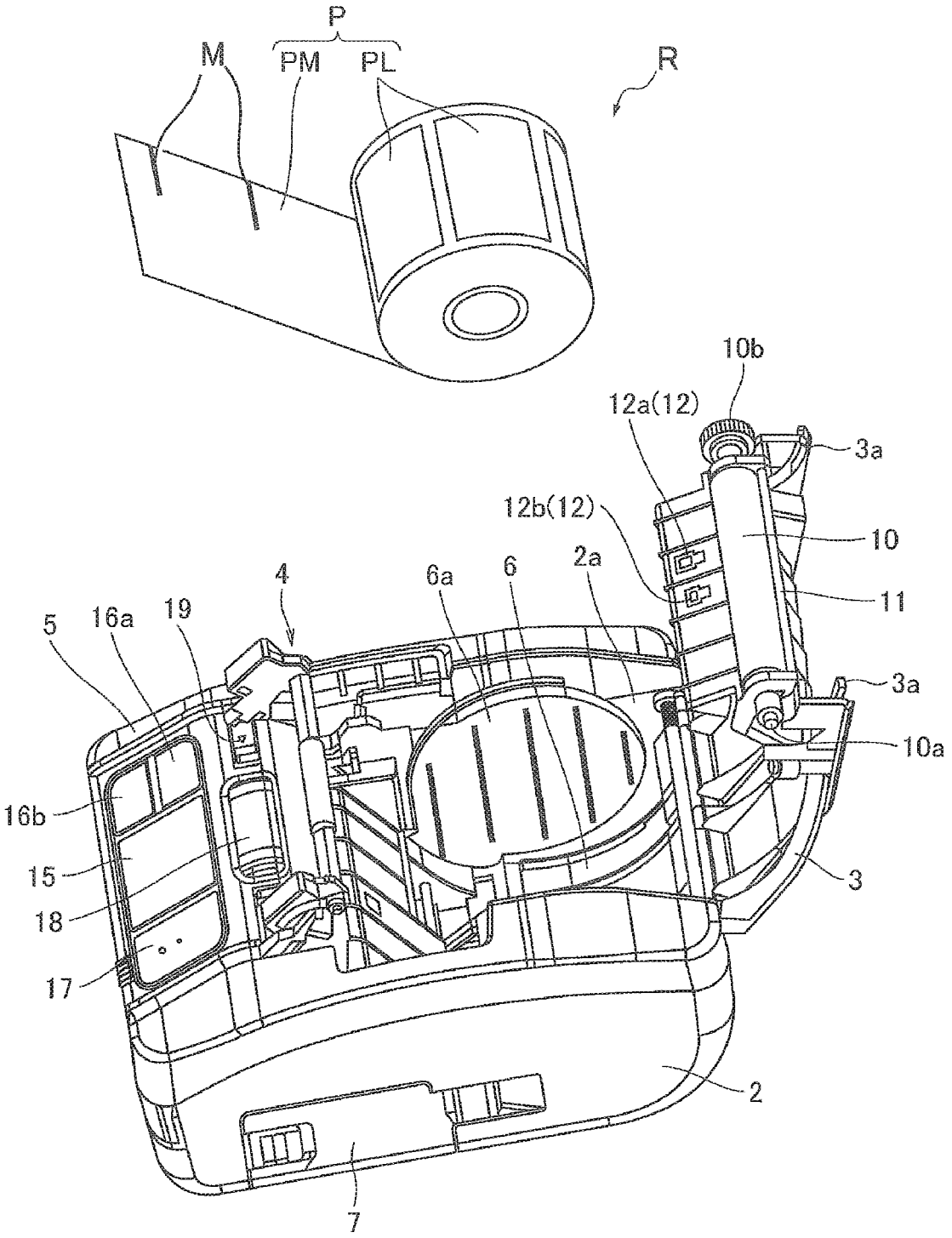
FIG. 3 is an overall perspective view showing the appearance of the printer of FIG. 1 when a cover is opened, and a paper roll.
Figure 4:
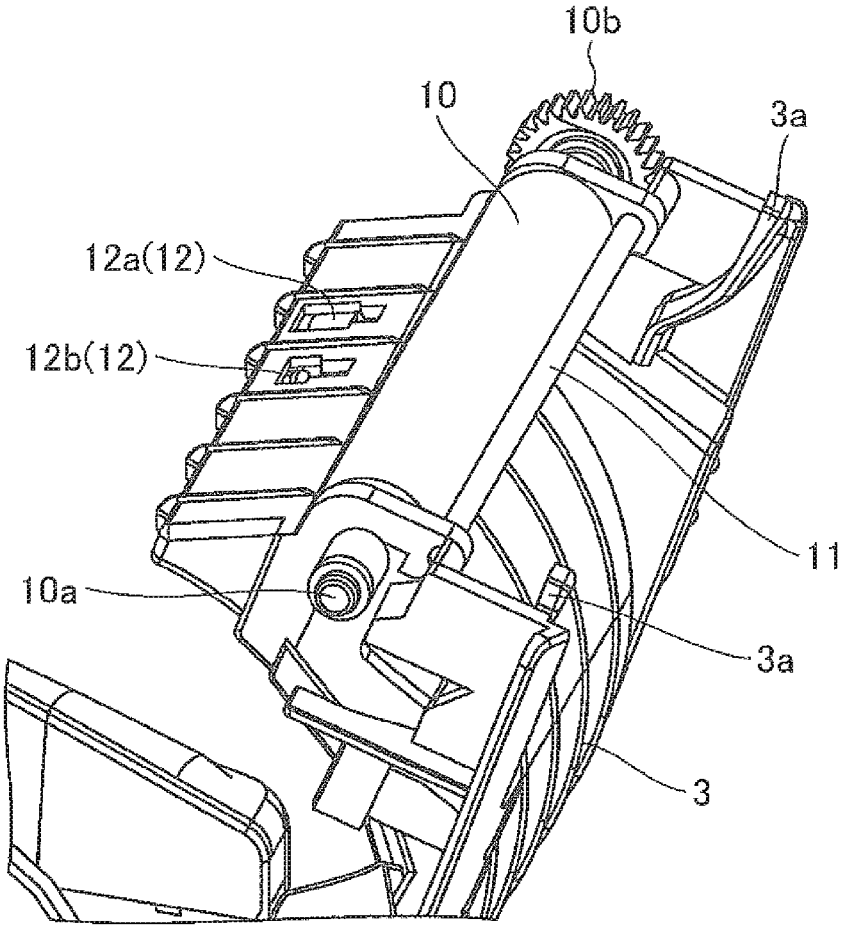
FIG. 4 is a perspective view showing the major components of the cover of the printer of FIG. 1.

A configuration of the printer according to the present embodiment will be described. FIG. 1 is an overall perspective view of the printer according to the present embodiment in the continuous ejection mode. FIG. 2 is an overall perspective view of the printer according to the present embodiment in the separation ejection mode. FIG. 3 is an overall perspective view showing the appearance of the printer of FIG. 1 when a cover is opened, and a paper roll. FIG. 4 is a perspective view showing the major components of the cover of the printer of FIG. 1.

As shown in FIGS. 1 and 2, the printer 1 of the present embodiment is a portable label printer that has a flat cuboid shape, for example. This printer 1 includes a body case 2, a cover 3, a separation unit (separation mechanism) 4, and a front cover 5. The printer 1 can be selectively switched between a continuous ejection mode (an example of a first operation mode) and a separation ejection mode (an example of a second operation mode).

The printer 1 may be used with its outlet EJ directed upward (transverse posture). The printer 1 may be used with its outlet EJ directed laterally (vertical posture). The printer 1 may be used with a belt hook (not illustrated) on the bottom of the printer 1 hanging from a belt of the operator, or can be used with a shoulder belt (not illustrated) hanged on the shoulder of the operator so as to place the outlet laterally (placing it vertically).

In the following description, a direction along the long side of the printer 1 having a cuboid shape is defined as a longitudinal direction. A side of the printer 1 on which a display unit 15, which will be described later, is disposed, is defined as a front side (FR), while the opposite side thereof is defined as a rear side (RR).

Assume that the printer 1 is located on a flat plane. In the following description, a section view, which will be referred to as appropriate, indicates a section in a case in which the printer 1 is cut with a plane orthogonal to that flat plane and along the longitudinal direction.

The body case 2 is a housing that defines a part of the outer shape of the printer 1. On one face of the body case 2, an opening 2*a* is formed as shown in FIG. 3. In this opening 2*a*, a paper container 6 is disposed. The paper container 6 is a region in which a paper roll R is contained. Inside of the paper container 6, a paper guide 6*a* is disposed. The paper guide 6*a* is configured to rotatably support a paper roll R while coming in contact with both end faces of the paper roll R, so as to guide a continuous paper extracted from the paper roll R while being fed. The paper guide 6*a* is movably disposed along the transverse direction of the paper roll R.

As shown in FIG. 3, a belt-shaped long strip of continuous paper P is wound into the paper roll R. The belt-shaped continuous paper P includes a belt-shaped mount PM and a plurality of labels PL (an example of a print medium). The plurality of labels PL temporarily adheres to the mount PM with predetermined intervals. The front face of the mount PM is hereinafter referred to as "a label attaching face" (an example of a first face).

The label attaching face of the mount PM is coated with a parting agent such as silicone for facilitating separation of the labels PL. On the rear face of the label attaching face of the mount PM (an example of a second face), location detection marks M indicating the locations of the labels PL are formed with predetermined intervals. The rear face of the label attaching face of the mount PM is an example of a second face.

A thermosensitive color developing layer is formed on a print face of the label PL. When the temperature reaches a predetermined range, the thermosensitive color developing layer develops a specific color. The rear face of the print face of the label PL is an adhesion surface on which an adhesive agent is coated. The adhesion surface is attached to the label attaching face of the mount PM, and thereby the labels PL temporarily adhere to the mount PM.

As shown in FIGS. 1 to 3, a battery cover 7 is pivotally supported openably and closably on the lateral face of the body case 2. The battery cover 7 is a cover of a battery container 33, which will be described later.

The cover 3 is a cover for opening and closing the paper container 6. The rear end of the cover 3 is pivotally supported at the rear end part of the body case 2 via a hinge, which allows the front end of the cover 3 to swing in a direction away from and closer to the body case 2. That is, the cover 3 is movable with respect to the body case 2.

The cover 3 is biased to the opening direction (the direction in which the front end of the cover 3 swings away from the body case 2) with a torsion spring (not illustrated in FIGS. 1 to 4) disposed at the rear end of the cover 3.

As shown in FIGS. 3 and 4, a pair of pressing parts 3*a* is disposed at the front end of the cover 3 on both ends in the width direction thereof. The pair of pressing parts 3*a* is configured to press the separation unit 4 so as to fix the separation unit 4 at a separation ejection position (an example of a first position) when the cover 3 is closed in the separation ejection mode.

As shown in FIGS. 3 and 4, a platen roller 10 is pivotally supported at the front end of the cover 3 so that the roller can rotate in a forward direction and a reverse direction. The platen roller 10 is configured to feed the continuous paper P (more specifically, the back face of the mount PM) along a feeding path. The platen roller 10 extends in the width direction of the continuous paper P.

The platen roller 10 has a platen shaft 10*a*, and a gear 10*b* is connected to one end of the platen shaft 10*a*. The gear 10*b* engages with a gear (not illustrated) or the like disposed in the opening 2*a* when the cover 3 is closed. Via that gear disposed in the opening 2*a*, the gear 10*b* is mechanically connected to a stepping motor (not illustrated) for driving the roller.

As illustrated in FIGS. 3 and 4, a separation pin 11 (an example of a separation member) is disposed at the cover 3 along the platen roller 10 and in the vicinity of the platen roller 10. Both ends of the separation pin 11 are pivotally supported at the cover 3.

As illustrated in FIGS. 3 and 4, sensors 12*a*, 12*b* (which are collectively referred to as "sensor 12") are disposed on a portion of the cover 3 in the vicinity of the platen roller 10. More specifically, the sensors 12*a*, 12*b* are disposed on a surface of the cover 3 facing a feeding path when the cover 3 is closed.

The sensor 12*a* is configured to detect a reference position of the label PL (namely, the location detection mark M of the mount PM). The sensor 12*a* is a reflective type optical sensor, for example. The sensor 12*b* is configured to detect presence or absence of the label PL (in other words, detect a portion of the mount PM to which the label PL adheres and a portion to which the label PL does not adhere). The sensor 12*b* is a thru-beam type optical sensor, for example.

In the separation ejection mode, the separation unit 4 is configured to diverge a feeding direction of the label PL on which printing has been performed and a direction of the mount PM at the downstream side from the platen roller 10 of the feeding path of the mount PM, thereby separating the label PL from the mount PM.

An end of the separation unit 4 in the longitudinal direction is movable between the continuous ejection position inside the printer 1 and the separation ejection position outside the printer 1. Details of the separation unit 4 will be described later.

As shown in FIGS. 1 to 3, the front cover 5 is fixed to the body case 2 so as to cover a part of the upper face of the printer 1 other than the cover 3. A display unit 15, operation buttons 16*a*, 16*b*, a power-supply button 17, a cover-open button 18, a pair of release levers 19 and a cutter 21 are disposed on the front cover 5.

The display unit 15 is a screen for displaying an operation command, a message or the like. The display unit 15 includes a liquid crystal display (LCD), for example. The operation buttons 16*a*, 16*b* are configured to manipulate the operation of the printer 1. The power-supply button 17 is configured to turn on or off a power supply of the printer 1.

The cover-open button 18 is configured to open the cover 3. The release levers 19 is configured to hold the separation unit 4 at the continuous ejection position. When the pair of the release levers 19 is moved closer to each other, holding the separation unit 4 at the continuous ejection position is cancelled.

The cutter 20 is configured to cut the mount PM to which the label PL adheres, after printing has been performed to the label PL. The cutter 20 is disposed at the front end of the front cover 5 on the opposite side of the cover 3. The cutter 20 extends along the width direction of the continuous paper P.

An outlet EJ is formed between the cover 3 and the front cover 5.

(2) CONFIGURATION OF THE SEPARATION UNIT

Figure 5:
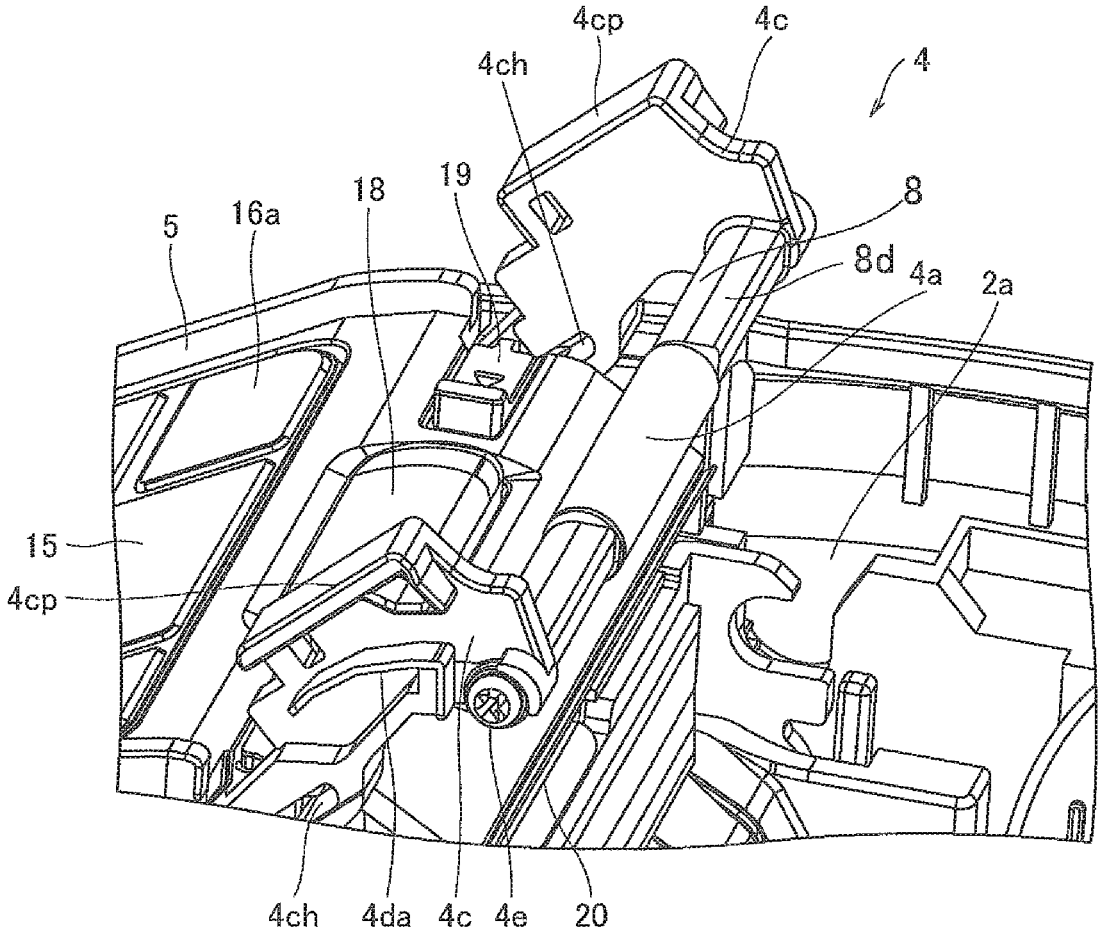
FIG. 5 is an enlarged perspective view of a separation unit of the printer in FIG. 2 and the surrounding major components.
Figure 6:
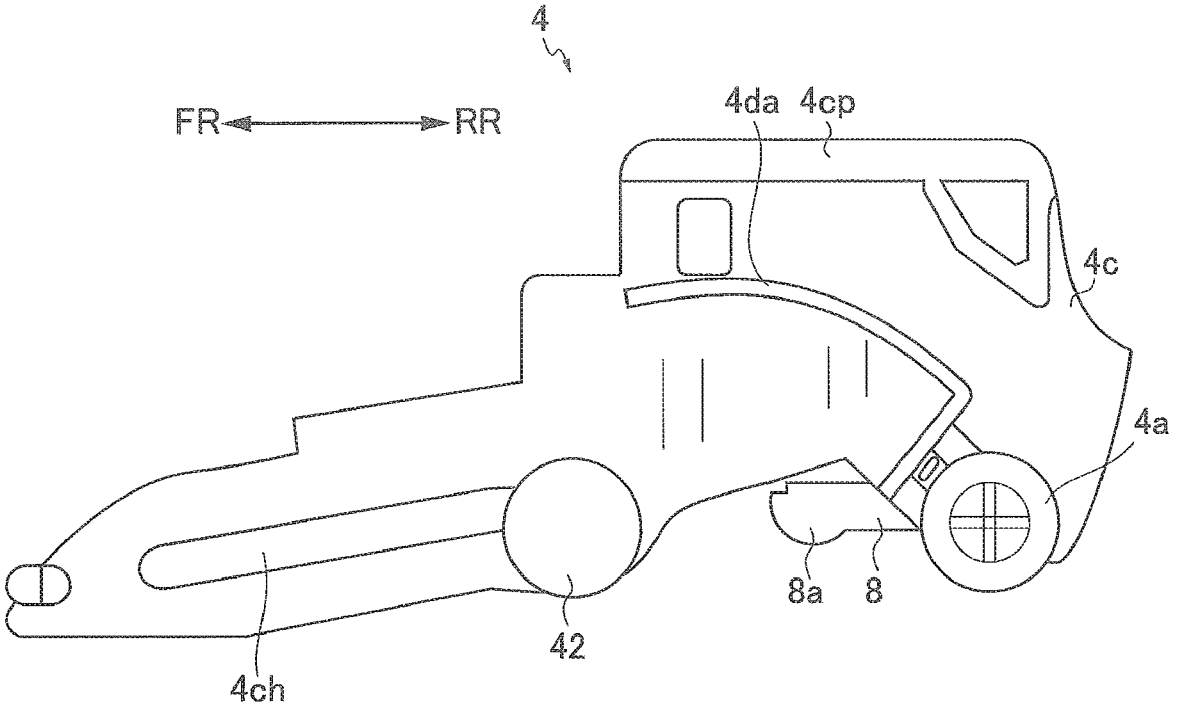
FIG. 6 is a lateral view showing the major components of the separation unit in FIG. 5.
Figure 7:
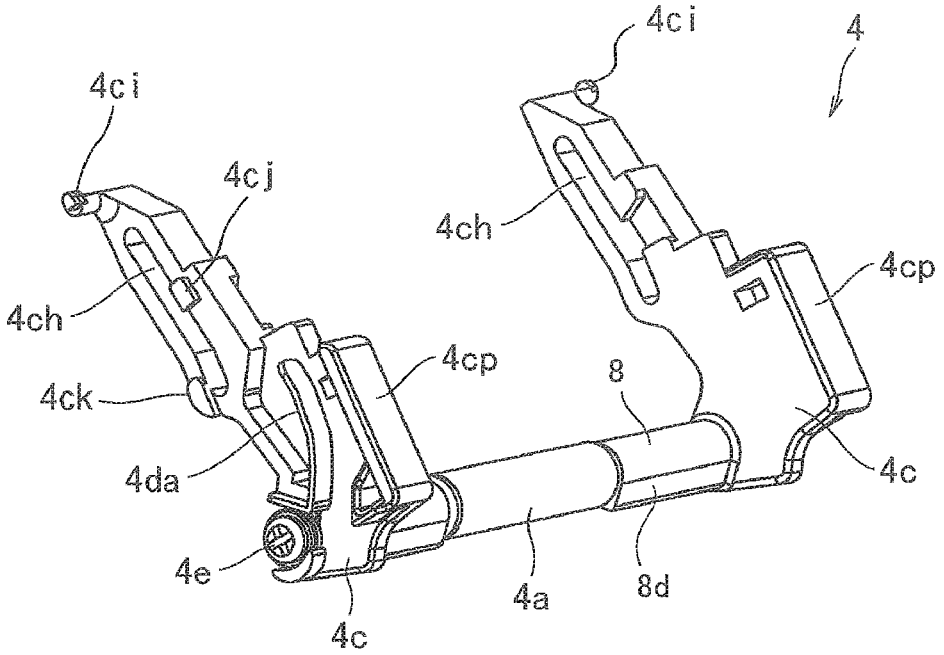
FIG. 7 is an overall perspective view showing the separation unit in FIG. 5.
Figure 8:
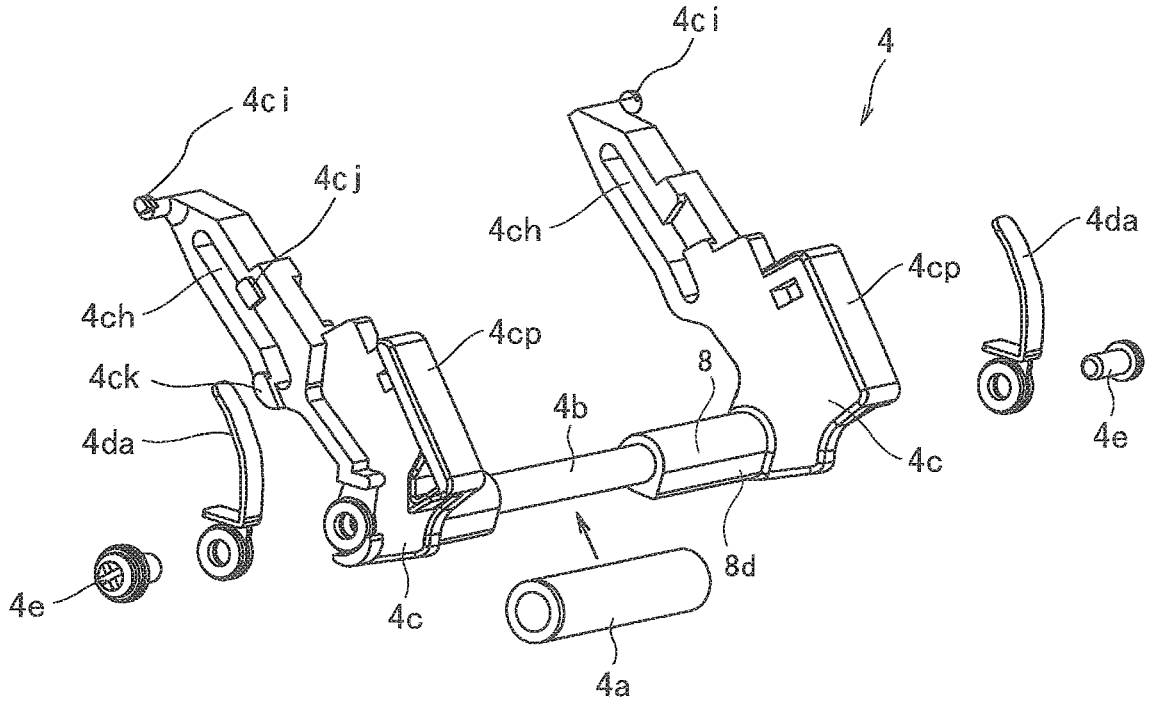
FIG. 8 is an exploded perspective view showing the separation unit in FIG. 7.

The following describes configuration of the separation unit 4 of the present embodiment. FIG. 5 is an enlarged perspective view of the separation unit in FIG. 2 and the surrounding major components. FIG. 6 is a lateral view showing the major components of the separation unit in FIG. 5. FIG. 7 is an overall perspective view showing the separation unit in FIG. 5. FIG. 8 is an exploded perspective view of the separation unit in FIG. 7.

As shown in FIGS. 5 to 8, the separation unit 4 includes a separation roller 4*a* (an example of a driven roller), a shaft 4*b*, a pair of supporters 4*c*, a pair of plate springs 4*da*, screws 4*e*, and a pair of pressing parts 8.

When the separation unit 4 is set at the separation ejection position, the separation roller 4*a* is located so as to be on a side spaced apart from a thermal head 28, which will be described later, with respect to the platen roller 10 and face the platen roller 10. The mount PM is fed while being pinched between the separation roller 4*a* and the platen roller 10. The separation roller 4*a* is made of elastic material such as rubber.

As shown in FIG. 8, the shaft 4*b* is provided between the pair of supporters 4*c*. The shaft 4*b* is sandwiched by the pair of supporters 4*c*. The shaft 4*b* is inserted into the pair of pressing parts 8 and the separation roller 4*a*. The pair of pressing parts 8 is provided at the both ends of the shaft 4*b*.

The separation roller 4*a* has a length that is shorter than the overall length of the shaft 4*b*. The separation roller 4*a* is located between the pair of pressing parts 8 (namely, at substantially the center in the axial direction of the shaft 4*b*). The separation roller 4*a* is pivotally and rotatably supported by the shaft 4*b*.

In the separation ejection mode, the separation roller 4*a* is located so as to be on a side spaced apart from the thermal head 28 with respect to the platen roller 10. Thereby, the mount PM from which the mount PM has been separated is pinched between the platen roller 10 and the separation roller 4*a*. At this time, the separation roller 4*a* is driven by the platen roller 10.

As shown in FIG. 6, a rib 8*a* is formed at the front end of each of the pair of pressing parts 8. The rib 8*a* projects in a direction from the separation roller 4*a* toward a guide rail hole 4*ch* (namely, FR direction). A projection 8*d* is formed at the rear end of each of the pair of pressing parts 8. The projection 8*d* is projected backward (RR) from the separation roller 4*a*. Illustration of the rib 8*a* is omitted in FIGS. 7 and 8.

The pair of supporters 4*c* is configured to support the shaft 4*b*. An cave 4*cp* is formed at an upper part on each of the pair of supporters 4*c*. The cave 4*cp* extends outwardly from a lateral face of each of the pair of supporters 4*c*. As illustrated in FIG. 7, a guide rail hole 4*ch*, which is a long hole, is formed on the front side (FR) of each of the pair of supporters 4*c*. The guide rail hole 4*ch* extends in the longitudinal direction of each of the pair of supporters 4*c*. The guide rail hole 4*ch* is configured to guide and restrict the movement of the separation unit 4.

A pair of shafts 42 is attached to a support board 41. The pair of shafts 42 is defined as a swing axis of the separation unit 4. The pair of shafts 42 is inserted into the guide rail holes 4*ch*, thereby fixing the separation unit 4 to the support board 41. Although the pair of shafts 42 is provided in accordance with the pair of supporters 4*c* in the present embodiment, the pair of shafts 42 and the pair of supporters 4*c* may be united.

A member other than the pair of shafts 42 may be applied as the swing axis of the separation unit 4. Any member such as protrusions can be applied as the separation unit 4 as long as such member functions as an axis.

The pair of plate springs 4*da* is an elastic structure configured to bias the separation roller 4*a* toward the platen roller 10. When the pressing parts 3*a* comes into contact with the pair of plate springs 4*da* in response to the closure of the cover 3, while the separation unit 4 moves to the separation ejection position, the biasing force of the pair of plate springs 4*da* is applied to the separation roller 4*a*.

As shown in FIG. 6, each of the pair of plate springs 4*da* is fixed at the rear side of the supporter 4*c* at outer lateral face of each supporter 4*c*. Each of the pair of plate springs 4*da* extends therefrom in a curve toward the front side (FR) of the supporter 4*c*. The terminal end of each of the pair of plate springs 4*da* floats.

(3) INTERNAL CONFIGURATION OF THE PRINTER

Figure 9:
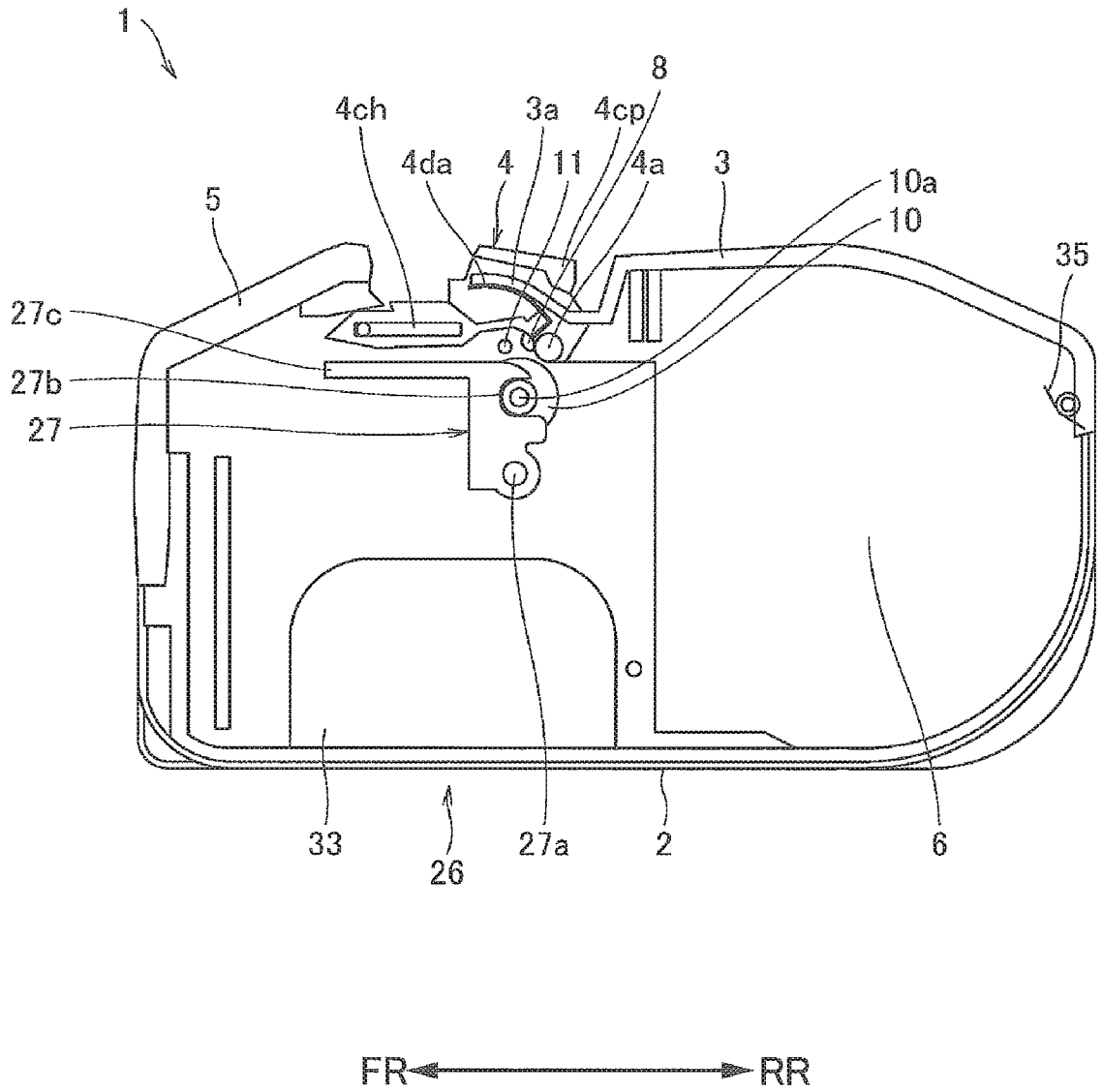
FIG. 9 is a schematic section view of the printer of FIG. 1 in the separation ejection mode.
Figure 10:
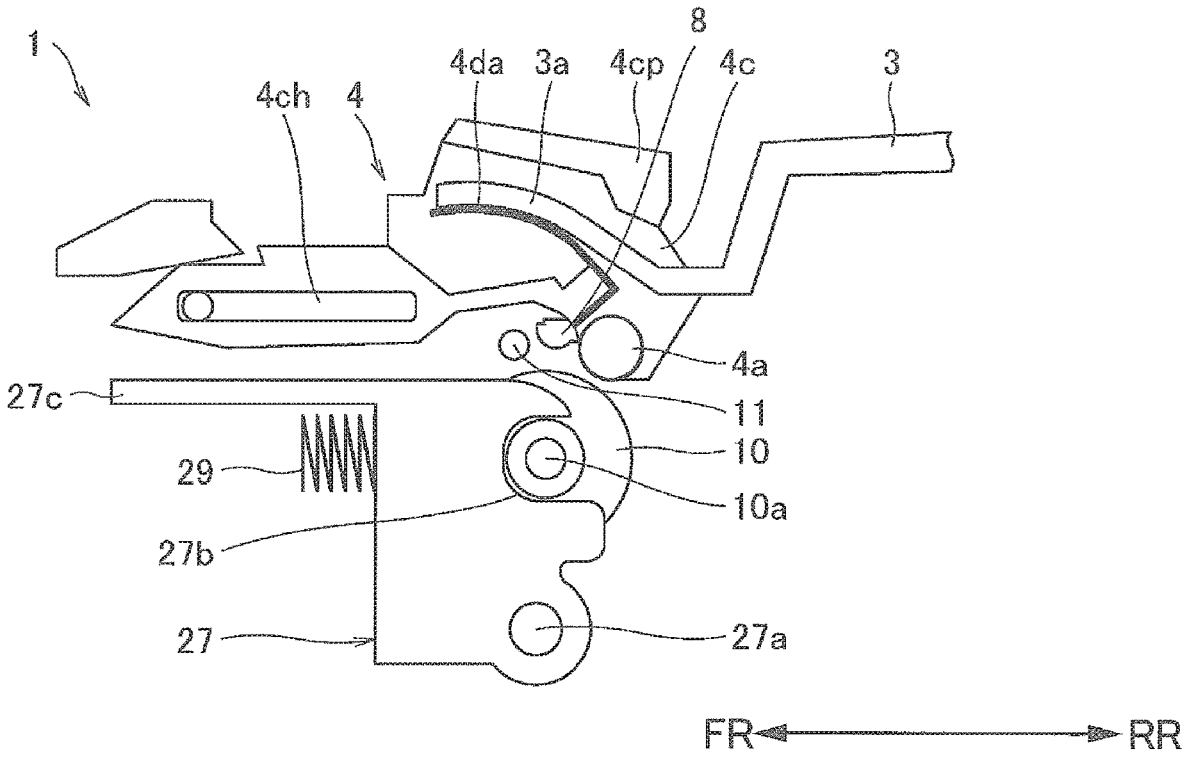
FIG. 10 is an enlarged view of the major components in FIG. 9.
Figure 11:
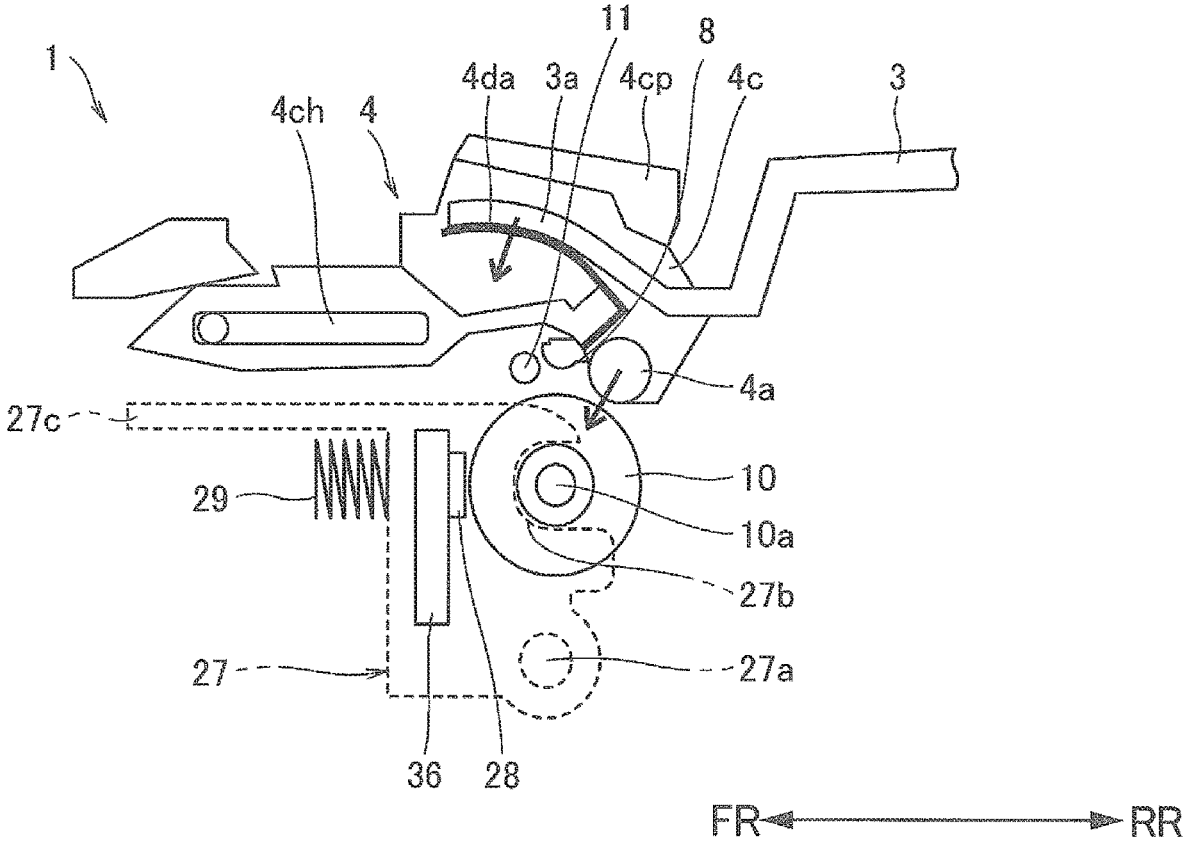
FIG. 11 is an enlarged view of the major components in FIG. 9 for explaining an action of the pair of pressing parts.

The internal configuration of the printer 1 will be described. FIG. 9 is a schematic section view of the inside of the printer in the separation ejection mode of FIG. 1. FIG. 10 is an enlarged schematic section view of the major components of the printer of FIG. 9. FIG. 11 is an enlarged schematic view similar to FIG. 8A and shows an action of the pressing parts of the cover.

As illustrated in FIGS. 9 to 11, a printing unit 26 is disposed in the body case 2. The printing unit 26 is adjacent to the paper container 6. The printing unit 26 is configured to print on the label PL. The printing unit 26 includes a head bracket 27, a thermal head (one example of a print head) 28, a coil spring 29, the separation unit 4 and a battery container 33.

The head bracket 27 is configured to hold the cover 3 when the cover 3 is closed. The head bracket 27 is swingable about a rotating shaft 27*a*. The head bracket 27 has a groove 27*b* and a pressing part 27*c*.

The platen shaft 10*a* of the platen roller 10 is fitted into the groove 27*b* so that the head bracket 27 holds the cover 3.

The pressing part 27*c* is disposed at a position opposed to the cover-open button 18 illustrated in FIGS. 1 and 2 (specifically, a position immediately below the cover-open button 18). When the cover-open button 18 is pressed, the pressing part 27*c* is pressed downward, thereby cancelling the holding of the cover 3. After the holding of the cover 3 is cancelled, the cover 3 will open by a biasing force of a torsion spring 35 that is disposed on the rear end of the cover 3.

The thermal head 28 is configured to print print information on the label PL. The print information includes letters, symbols, graphics, barcodes, a combination of these or the like. The thermal head 28 is mounted at the head bracket 27 via a circuit board 36. A face of the thermal head 28 that does not face the circuit board 36, which is hereinafter referred to as "a print face", faces the platen roller 10 and also faces the feeding path of the mount PM and the labels PL, when the cover 3 is closed. On the print face of the thermal head 28, a plurality of heater resistors (heater elements) are provided. The plurality of heater resistors is arranged along the width direction of the continuous paper P. Each heater resistor generates heat when applying current.

The circuit board 36 is a wiring board configured to transmit print signals to the thermal head 28.

The coil spring 29 is configured to bias the head bracket 27 and the thermal head 28 toward the platen roller 10 when the cover 3 is closed. The coil spring 29 is disposed on the rear side of the head bracket 27 (namely, the face to which the thermal head 28 is not fixed). The coil spring 29, with the biasing force thereof, presses the head bracket 27 toward the platen roller 10. Thus, the platen shaft 10*a* fitted into the groove 27*b* of the head bracket 27 is pressed firmly. Thereby, the holding of the cover 3 by the head bracket 27 is maintained.

As illustrated in FIG. 11, the pressing part 3*a* of the cover 3 is located at a gap between the eave 4*cp* and the plate spring 4*da* of the separation unit 4 in the separation ejection mode. The pressing part 3*a* comes in contact with and presses the plate spring 4*da* downward so as to press the separation unit 4. Thus, the separation unit 4 is fixed at the separation ejection position, and the separation roller 4*a* of the separation unit 4 can be biased stably toward the platen roller 10.

(4) CONFIGURATION OF THE SUPPORT BOARD

Figure 12:
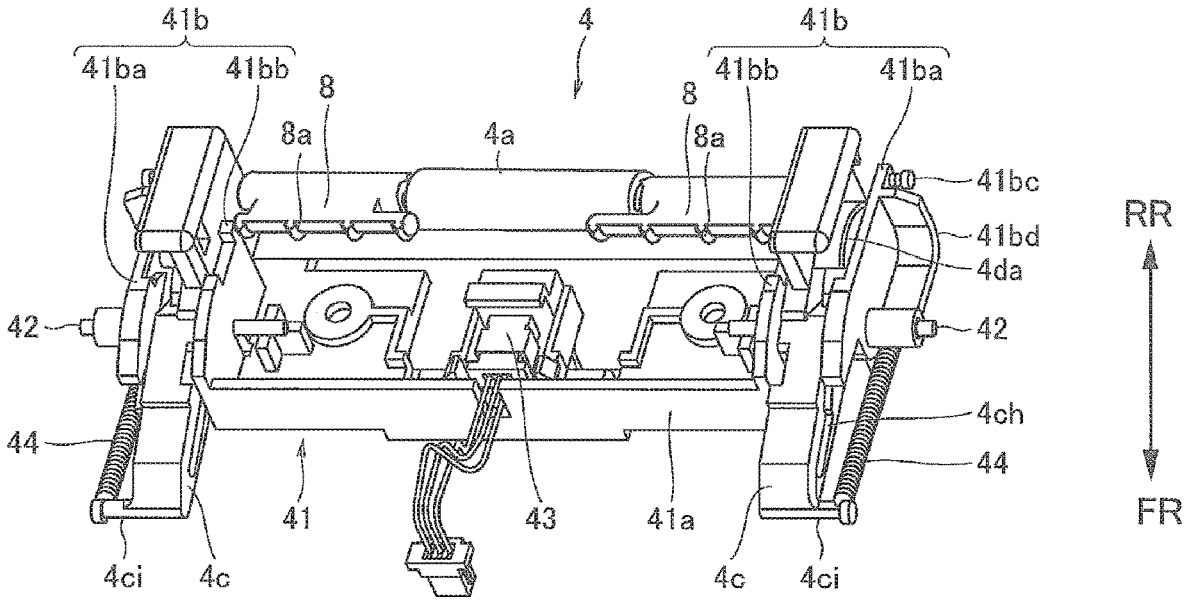
FIG. 12 is a perspective view showing the separation unit and the support board at the continuous ejection position.
Figure 13:
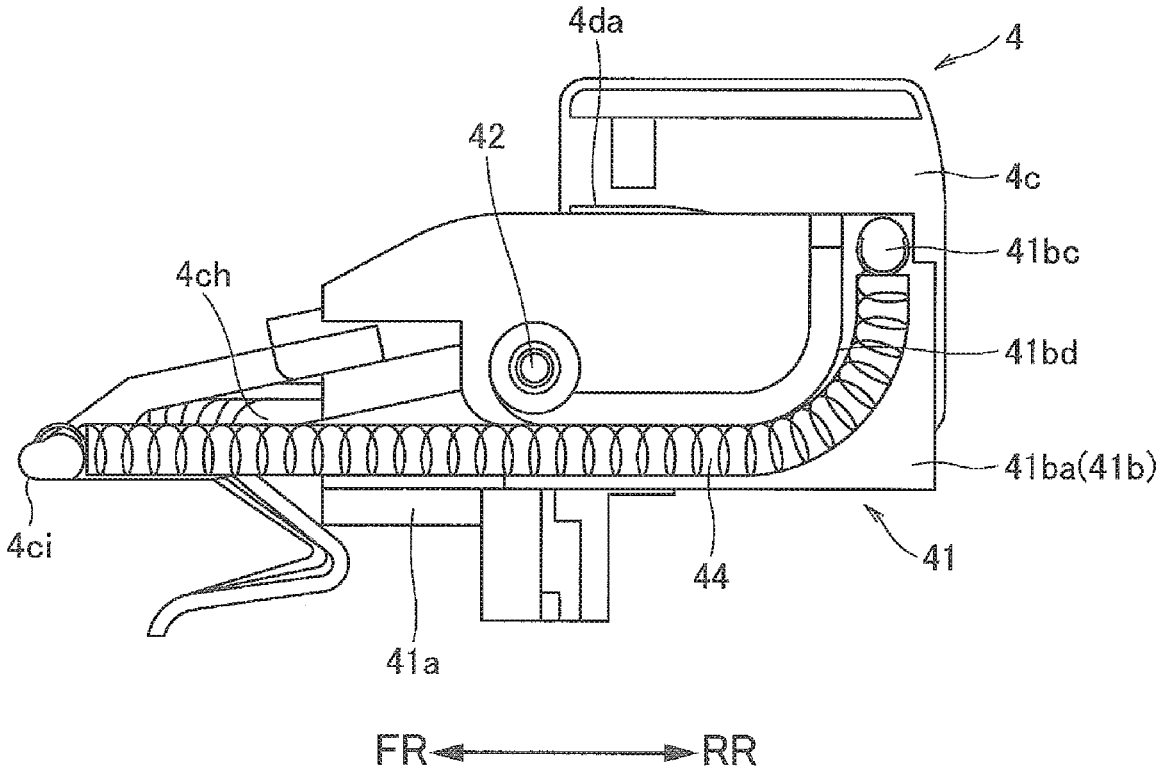
FIG. 13 is a lateral view of the separation unit and the support board of FIG. 12.
Figure 14:
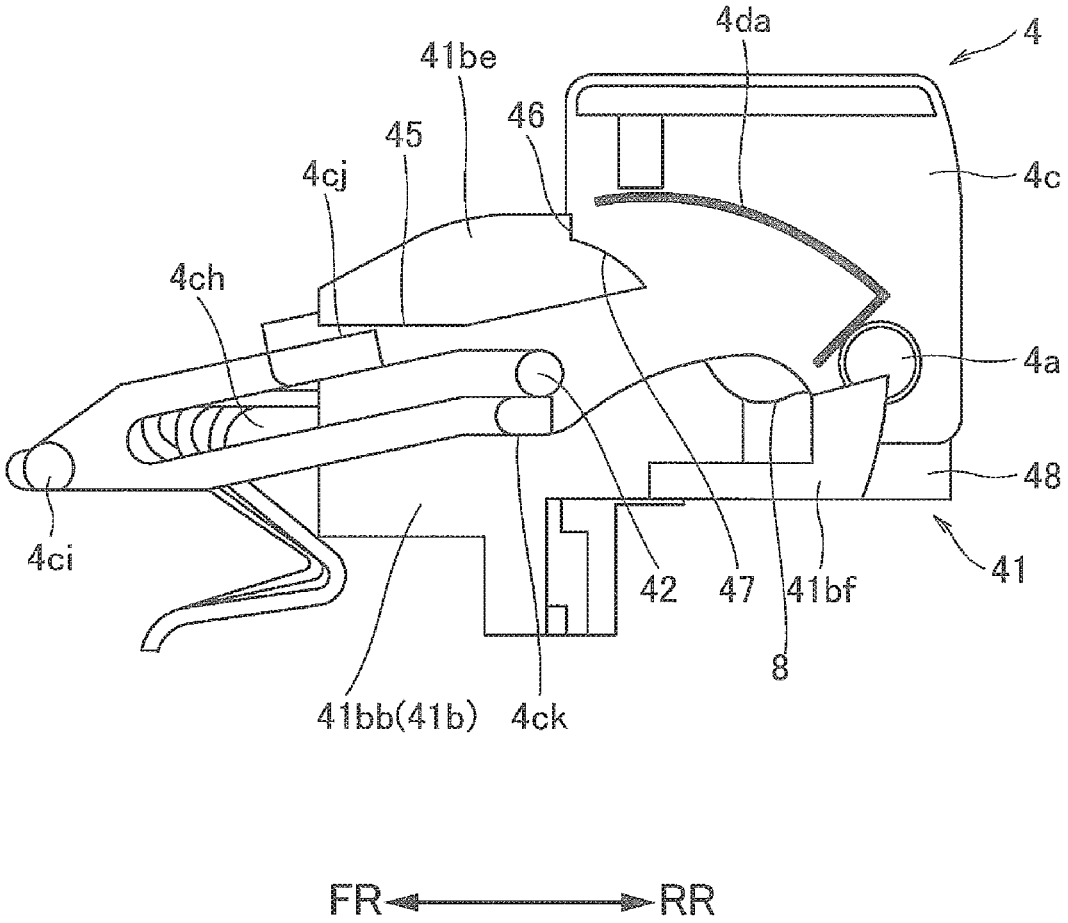
FIG. 14 shows the relationship between the separation unit and the support board of FIG. 13.

A configuration of the support board 41 will be described below. FIG. 12 is a perspective view showing the separation unit and the support board at the continuous ejection position. FIG. 13 is a lateral view of the separation unit and the support board of FIG. 12. FIG. 14 shows the relationship between the separation unit and the support board in FIG. 13.

As illustrated in FIG. 12, a plurality of ribs 8*a* is formed at the front end of the pair of pressing parts 8. Each rib 8*a* protrudes forward (FR) and downward from the front end of the pair of pressing parts 8.

As shown in FIGS. 12 to 14, the support board 41 is disposed in the body case 2. The support board 41 has a base 41*a* and a pair of unit attachment parts 41*b*.

A separation sensor 43 is disposed at the base 41*a*. The separation sensor 43 is a light-reflective type sensor configured to detect presence or absence of the label PL in the separation ejection mode.

The pair of unit attachment parts 41*b* is disposed at the both ends of the base 41*a* in the width direction. The separation unit 4 is attached to the pair of unit attachment parts 41*b*. Each of the unit attachment parts 41*b* includes a first attachment piece 41*ba* and a second attachment piece 41*bb*. The first attachment piece 41*ba* is located outside in the width direction of the base 41*a* (that is, in the lateral direction of the printer 1). The second attachment piece 41*bb* is located inside in the width direction of the base 41*a*. This second attachment piece 41*bb* faces the first attachment piece 41*ba*. A gap in the lateral direction is formed between the first attachment piece 41*ba* and the second attachment piece 41*bb*. The supporter 4*c* of the separation unit 4 is disposed at the gap and sandwiched between the first attachment piece 41*ba* and the second attachment piece 41*bb*.

At each of the pair of unit attachment parts 41*b*, a shaft 42 is mounted so as to extend between the first attachment piece

41*ba* and the second attachment piece 41*bb*. The shaft 42 is inserted into the guide rail hole 4*ch* and engages with the guide rail hole 4*ch*.

The separation unit 4 can slide in the longitudinal direction along the guide rail hole 4*ch*. That is, the separation unit 4 is movable with respect to the shaft 42. Further, the separation unit 4 can swing about the shaft 42.

As illustrated in FIGS. 12 and 13, a coil spring 44 is mounted between the separation unit 4 and the support board 41. An attachment protrusion 41*bc* is disposed at the rear end of each of the pair of the unit attachment parts 41*b*. An attachment protrusion 4*ci* is disposed on each of the front end of the supporter 4*c*.

A guide eave 41*bd* is disposed on the support board 41. The guide eave 41*bd* is formed to bend like a substantially L-letter shape extending from the attachment protrusion 41*bc* toward a lateral face of the first attachment piece 41*ba*.

One end of the coil spring 44 is attached to the attachment protrusion 41*bc*, while the other end of the coil spring 44 is attached to an attachment protrusion 4*ci*. The coil spring 44 extends forward in a curve along the guide cave 41*bd*.

With the coil spring 44, a biasing force is applied to the separation unit 4 to such a direction that the frond end of the guide rail hole 4*ch* on the attachment protrusion 4*ci* side comes into contact with the shaft 42. With the coil spring 44, a biasing force is also applied to the separation unit 4 so as to swing about the front end of the guide rail hole 4*ch* in such a direction that a front end of the separation unit 4 is further spaced apart from the thermal head 28 (which is referred to as "the first rotation direction"). That is, with the coil spring 44, the separation unit 4 is given two biasing forces, i.e. a biasing force with which the separation unit 4 slides to the rear side (RR) and a biasing force with which the separation unit 4 swings to the first rotation direction.

After the setting at the continuous ejection position is cancelled by the release levers 19, the biasing force of the coil spring 44 causes the separation unit 4 to slide to a position where the shaft 42 comes into contact with the front end of the guide rail hole 4*ch* (which is hereinafter referred to as "a slide end position"). The slide end position is an example of a second position. The separation unit 4 then swings about the shaft 42 to the first rotation direction.

As illustrated in FIG. 14, the supporter 4*c* of the separation unit 4 includes a first claw 4*cj*, a second claw 4*ck*, a first protrusion 41*be*, and a second protrusion 41*bf*. The first claw 4*cj* is located above the guide rail hole 4*ch*. The second claw 4*ck* is located below the guide rail hole 4*ch*. On a face of the first attachment piece 41*ba* opposed to the second attachment piece 41*bb*, the first protrusion 41*be* and the second protrusion 41*bf* are disposed.

The first protrusion 41*be* has a guide surface 45, a first stopper 46, and a restriction surface 47.

The guide surface 45 is configured to guide the separation unit 4 in the longitudinal direction. While the separation unit 4 slides in the longitudinal direction, the first claw 4*cj* slides along the guide surface 45. Thereby, the separation unit 4 is guided in the longitudinal direction.

The first stopper 46 is a member configured to define a swing end positon (an example of a second position) of the separation unit 4. The separation unit 4 stop swinging at the swing end positon where the first claw 4*cj* comes in contact with the first stopper 46.

The restriction surface 47 is configured to restrict movement of the separation unit 4 to return to the continuous ejection position. When the separation unit 4 swings to a second rotation position opposite to the first rotation direction (that is, the separation roller 4*a* moves in such a direction that the separation roller 4*a* comes closer to the thermal head 28), the first claw 4*cj* slides on the restriction surface 47. Thereby, movement of the separation unit 4 is restricted to return to the continuous ejection position.

When the separation unit 4 is at the swing end position, a rear end of the separation unit 4 is within the swing trajectory of the cover 3.

Meanwhile, the second protrusion 41*bf* has a second stopper 48. The second stopper 48 is a member configured to restrict movement of the separation unit 4 to return to the continuous ejection position. When the separation unit 4 is set at the separation ejection position, the second claw 4*ck* comes in contact with the second stopper 48, thereby restricting movement of the separation unit 4 to return to the continuous ejection position.

(5) THE CONTINUOUS EJECTION POSITION AND THE SEPARATION EJECTION POSITION

The continuous ejection position and the separation ejection position according to the present embodiment will be described below.

(5-1) Movement Between the Continuous Ejection Position and the Separation Ejection Position Movement between the continuous ejection position and the separation ejection position will be described below. FIGS. 15 to 20 each illustrates a schematic section view of the major components of the printer showing a state of the separation unit and the cover when the separation unit of FIG. 5 is going to be set at the continuous ejection position sequentially.

Figure 15:
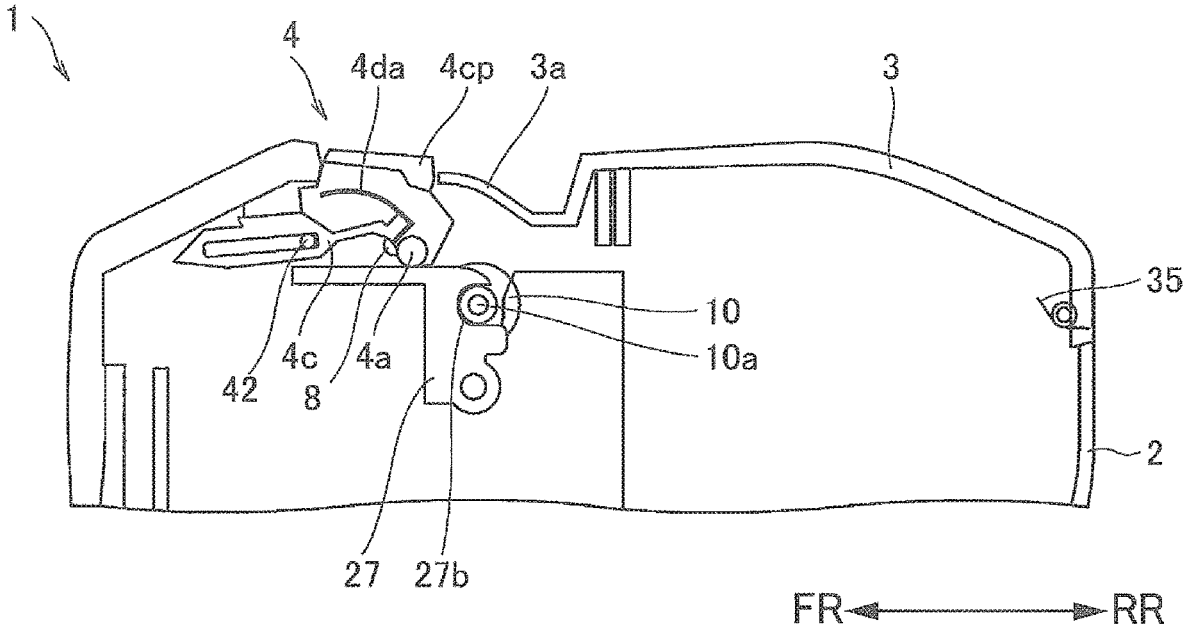
FIG. 15 is a schematic section view of the major components of the printer showing a state of the separation unit and the cover when the separation unit of FIG. 5 is going to be set at the continuous ejection position sequentially.

FIG. 15 illustrates a sectional view of the printer 1 when the separation unit 4 is set at the continuous ejection position. When the separation unit 4 is set at the continuous ejection position, the rear end of the guide rail hole 4*ch* comes in contact with the shaft 42 against the biasing force of the coil spring 44. At this time, the separation roller 4*a* is set at such a position that the separation roller 4*a* is not opposed to the platen roller 10 (an example of a second position). That is, the separation roller 4*a* is spaced apart from the platen roller 10 when the separation unit 4 is set at the continuous ejection position.

Figure 16:
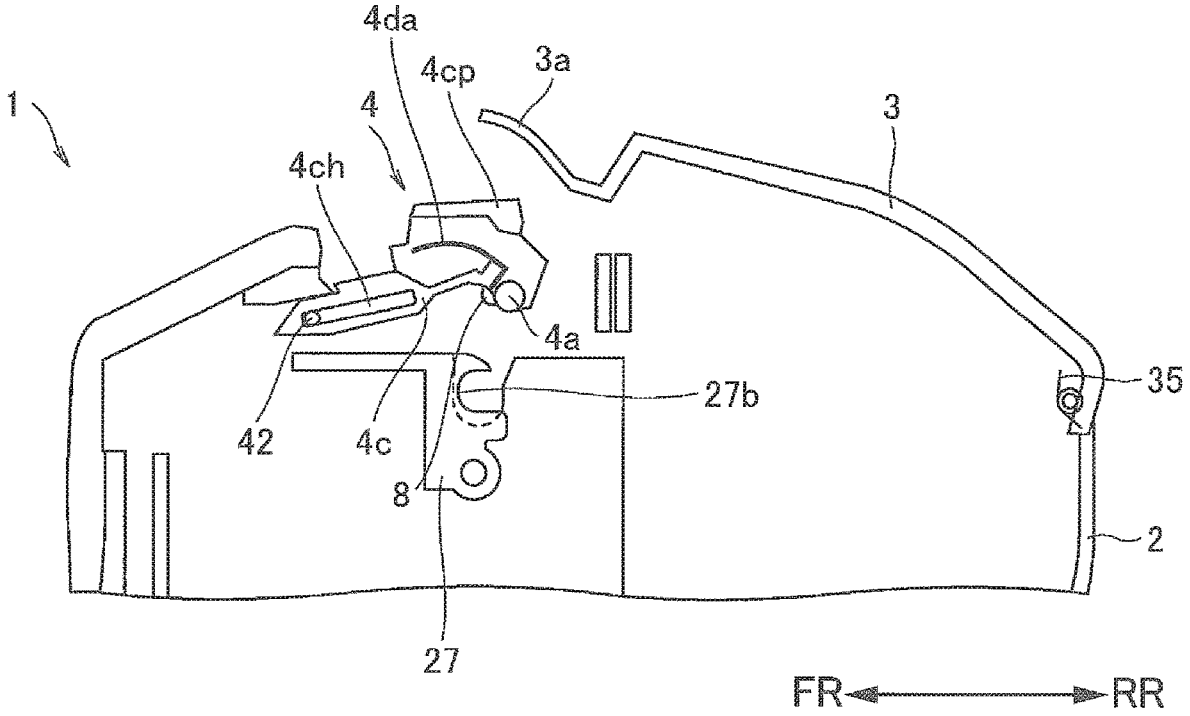
FIG. 16 is a schematic section view of the major components of the printer showing a state of the separation unit and the cover when the separation unit of FIG. 5 is going to be set at the continuous ejection position sequentially.

When the cover-open button 18 is pushed to set the cover 3 at the open position and the release lever 19 is operated to cancel the holding of the separation unit 4 in FIG. 15, the separation unit 4, as shown in FIG. 16, slides in the rear direction (RR) along the guide rail hole 4*ch* with the biasing force of the coil spring 44. The separation unit 4 then stops at the slide end position. Since the first claw 4*cj* slides along the guide surface 45 as the separation unit 4 slides, the separation unit 4 can slide smoothly.

Figure 17:
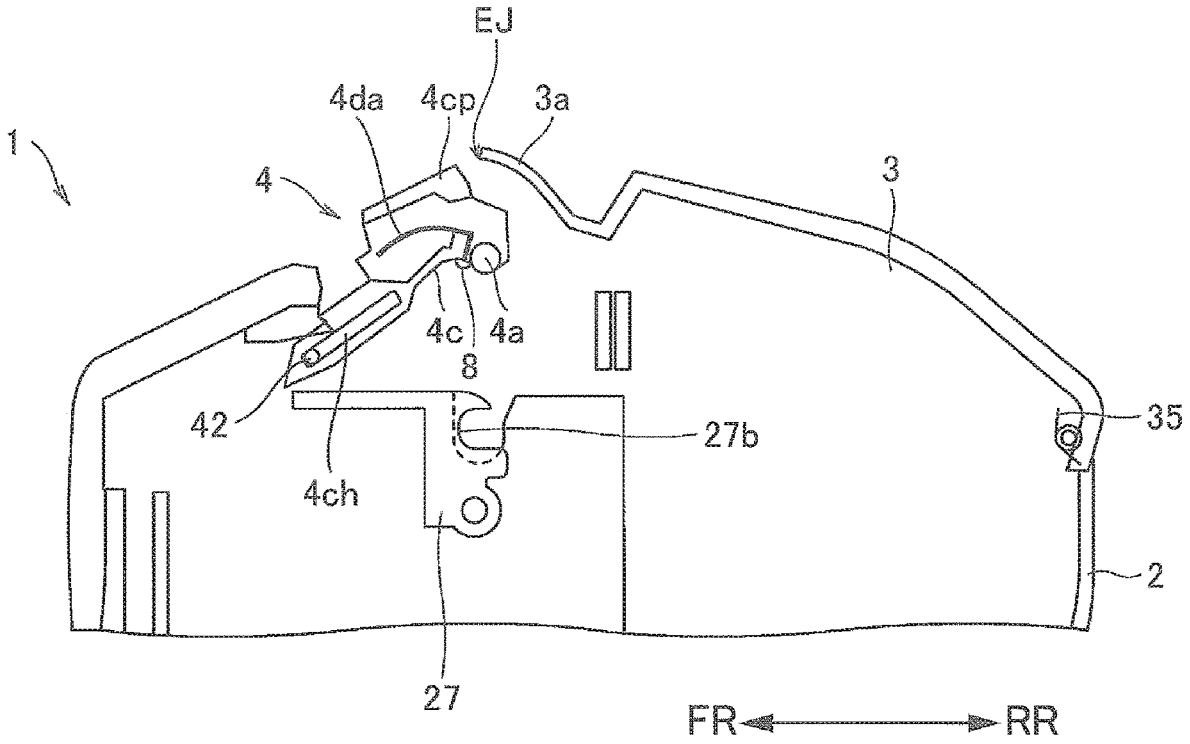
FIG. 17 is a schematic section view of the major components of the printer showing a state of the separation unit and the cover when the separation unit of FIG. 5 is going to be set at the continuous ejection position sequentially.

As shown in FIG. 17, after stopping at the slide end position, the separation unit 4 swings about the shaft 42 to the first rotation direction with the biasing force of the coil spring 44. The first rotation direction is a direction in which the separation roller 4*a* moves upward. After swinging to the first rotation direction, the separation unit 4 stops at the swing end position. When the separation unit 4 stops at the swing end position, a front end of the separation unit 4 at the swing end position is within the swing trajectory of the cover 3. When the separation unit 4 is at the swing end position, the outlet EJ is open. Thereby, the paper roll R can be contained easily.

Figure 18:
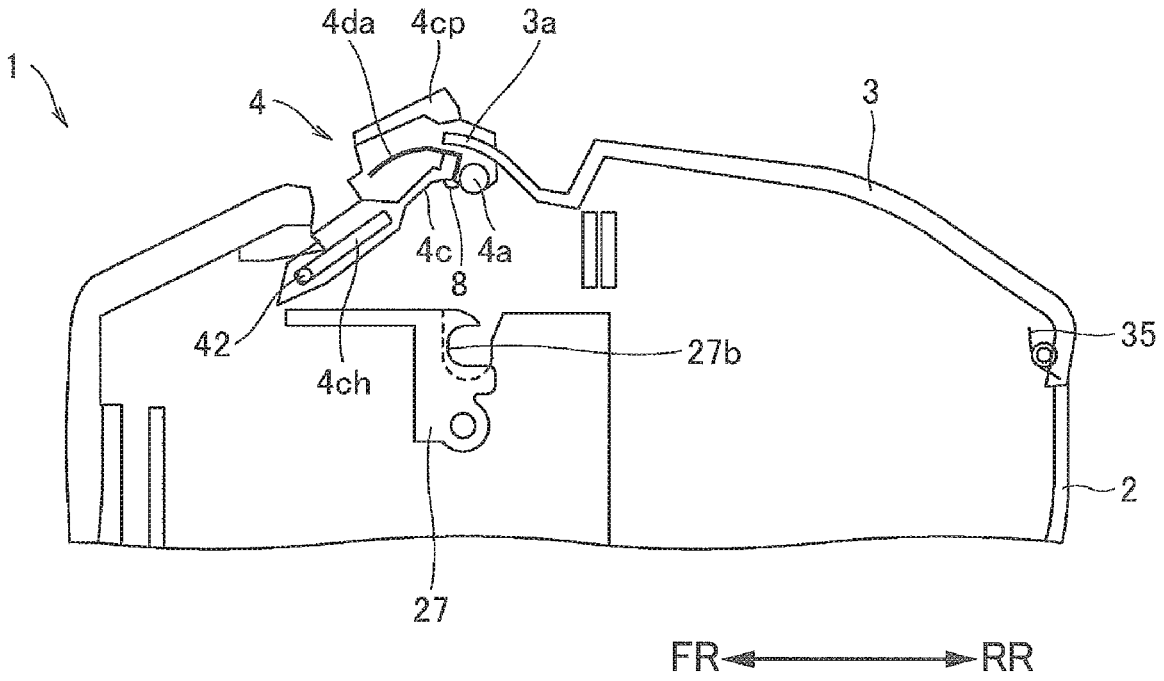
FIG. 18 is a schematic section view of the major components of the printer showing a state of the separation unit and the cover when the separation unit of FIG. 5 is going to be set at the continuous ejection position sequentially.

As shown in FIG. 18, when the separation unit 4 is at the swing end position, closing of the cover 3 causes a front end of the cover 3 (an example of a portion of the cover 3) to engage with a front end of the separation unit 4 (an example of a portion of the driven roller). That is, the swing end position is a position where the portion of the cover 3 comes first in contact with the portion of the separation unit 4 when the cover 3 swings from an open position to a closed position. In other words, as soon as the portion of the cover 3 comes in contact with the portion of the separation unit 4 when the cover 3 swings from the open position to the closed position, the separation unit 4 is located at the swing end position. After being located at the swing end position, the separation unit 4 then swings to the second rotation direction against the biasing force of the coil spring 44.

Figure 19:
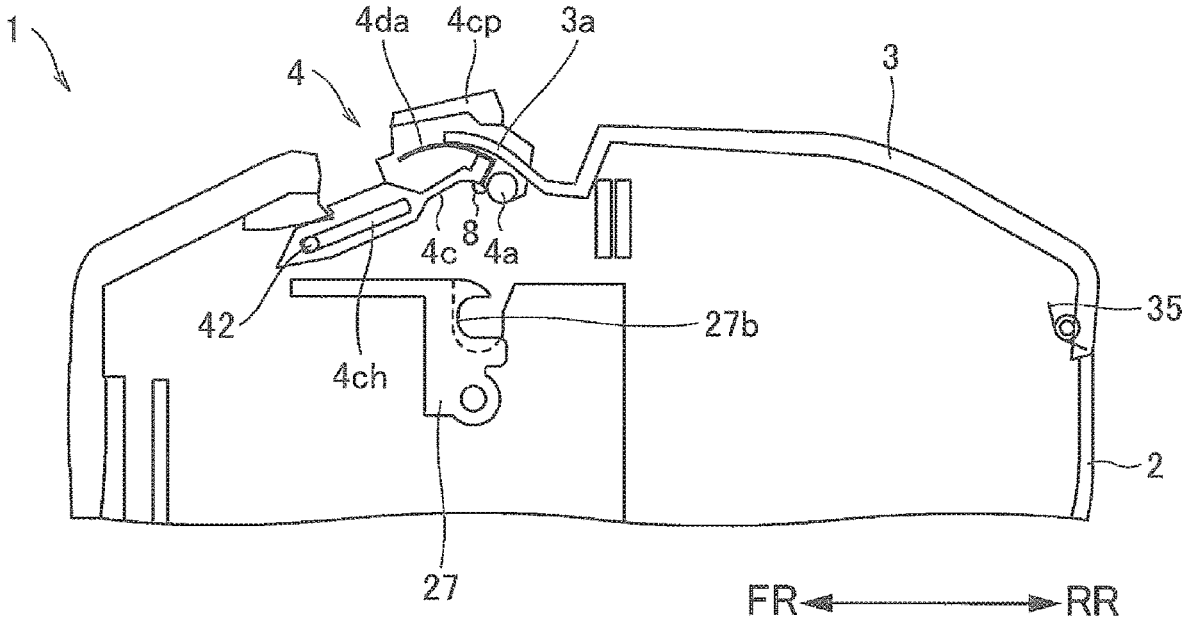
FIG. 19 is a schematic section view of the major components of the printer showing a state of the separation unit and the cover when the separation unit of FIG. 5 is going to be set at the continuous ejection position sequentially.

As shown in FIG. 19, as the cover 3 is further approached to the closed position, the separation unit 4 swings further to the second rotation direction. At this time, the first claw 4*cj* slides along the restriction surface 47, thereby restricting movement of the separation unit 4 to return to the continuous ejection position.

Figure 20:
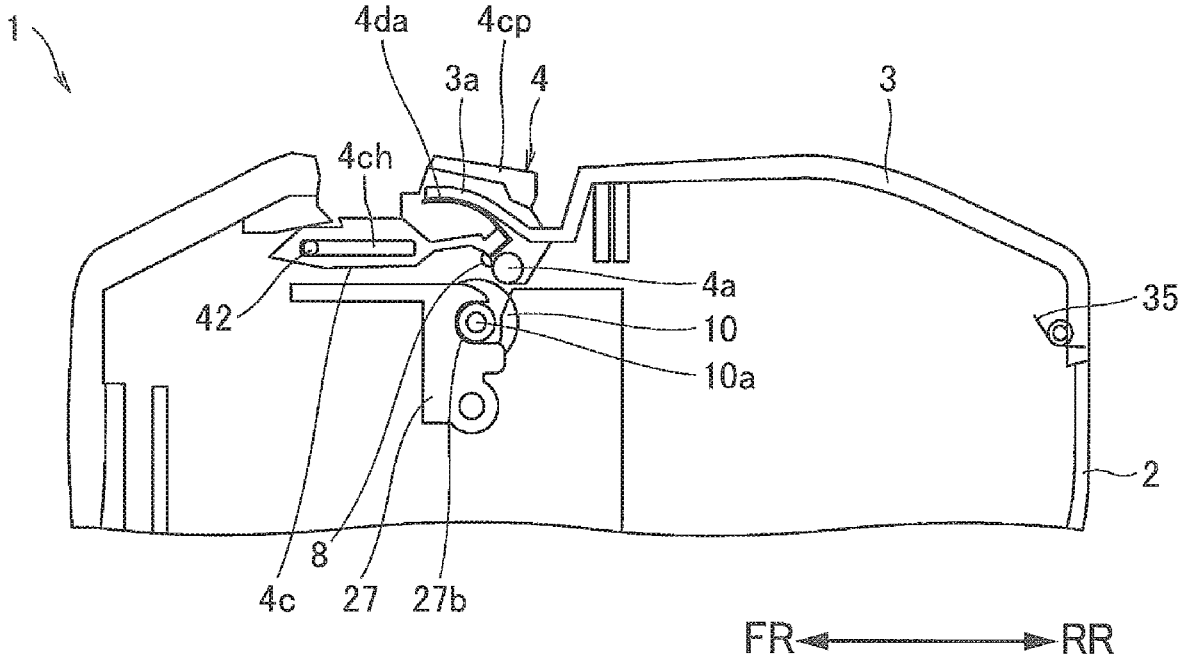
FIG. 20 is a schematic section view of the major components of the printer showing a state of the separation unit and the cover when the separation unit of FIG. 5 is going to be set at the continuous ejection position sequentially.

As shown in FIG. 20, when the cover 3 is closed, the platen shaft 10*a* is fitted into the groove 27*b* of the head bracket 27. Thereby, the closed status of the cover 3 is maintained. The separation roller 4*a* is biased to the platen roller 10 side and held at the separation ejection position. At this time, the second claw 4*ck* comes in contact with the second stopper 48, thereby restricting movement of the separation unit 4 to return to the continuous ejection position.

(5-2) Action of the Pair of Pressing Parts

Figure 21:
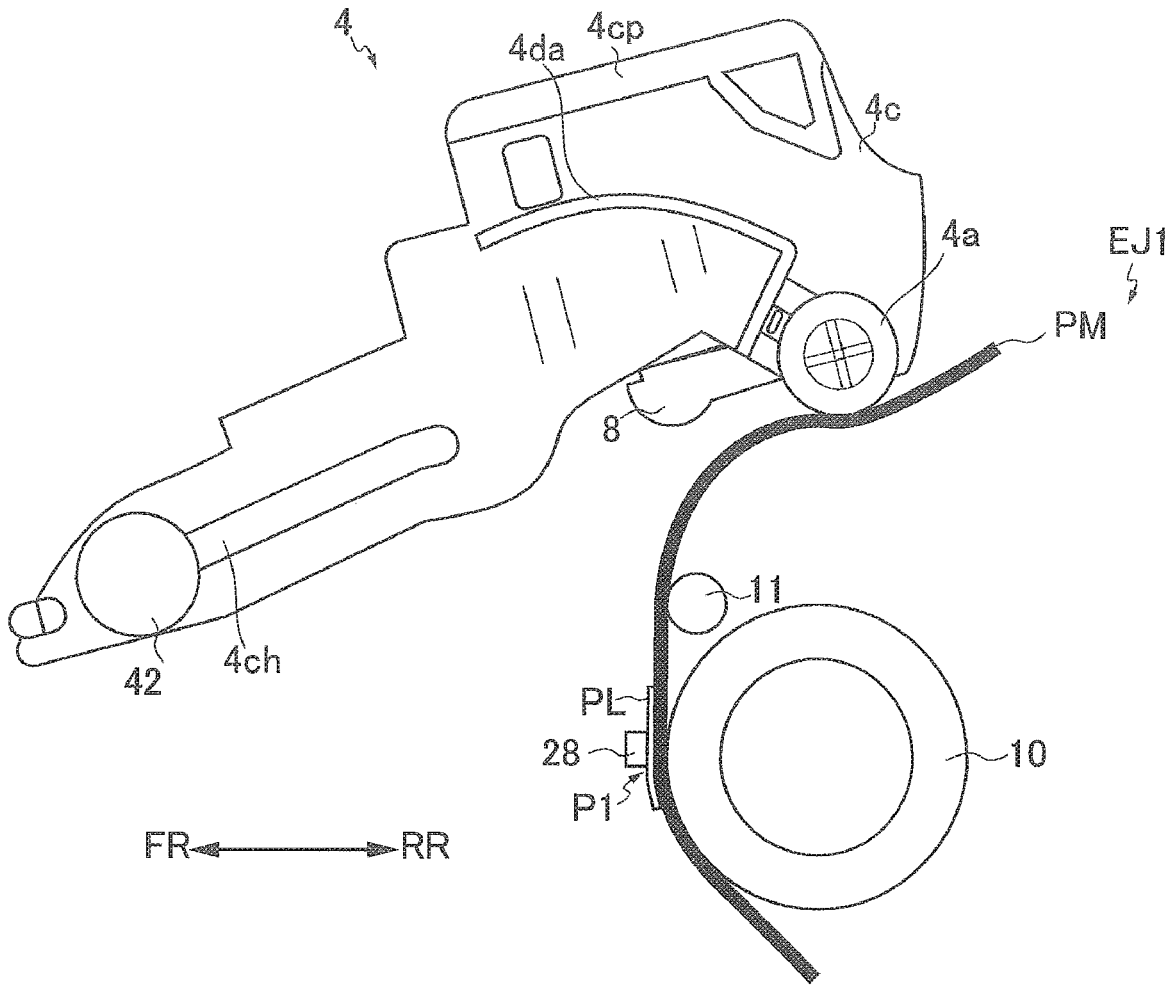
FIG. 21 is an explanatory view of an action of the pair of pressing parts of FIG. 6.
Figure 22:
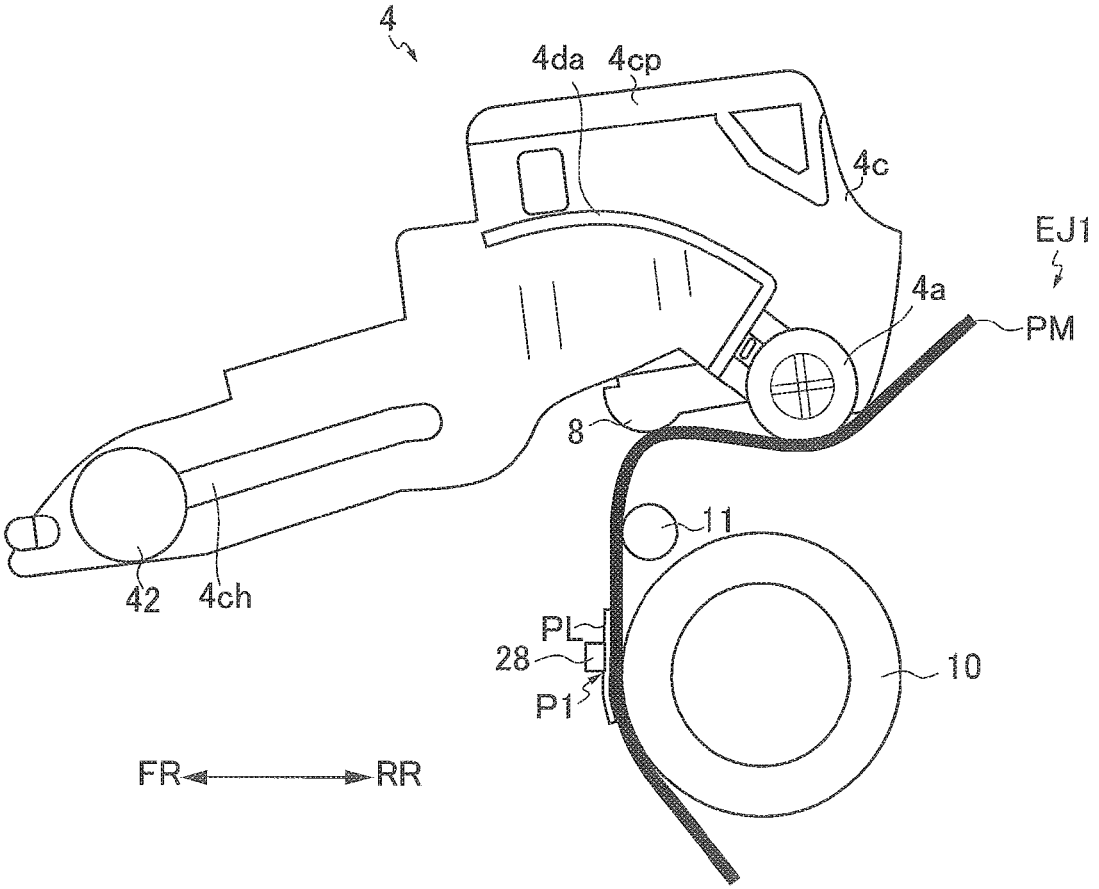
FIG. 22 is an explanatory view of an action of the pair of pressing parts of FIG. 6.
Figure 23:
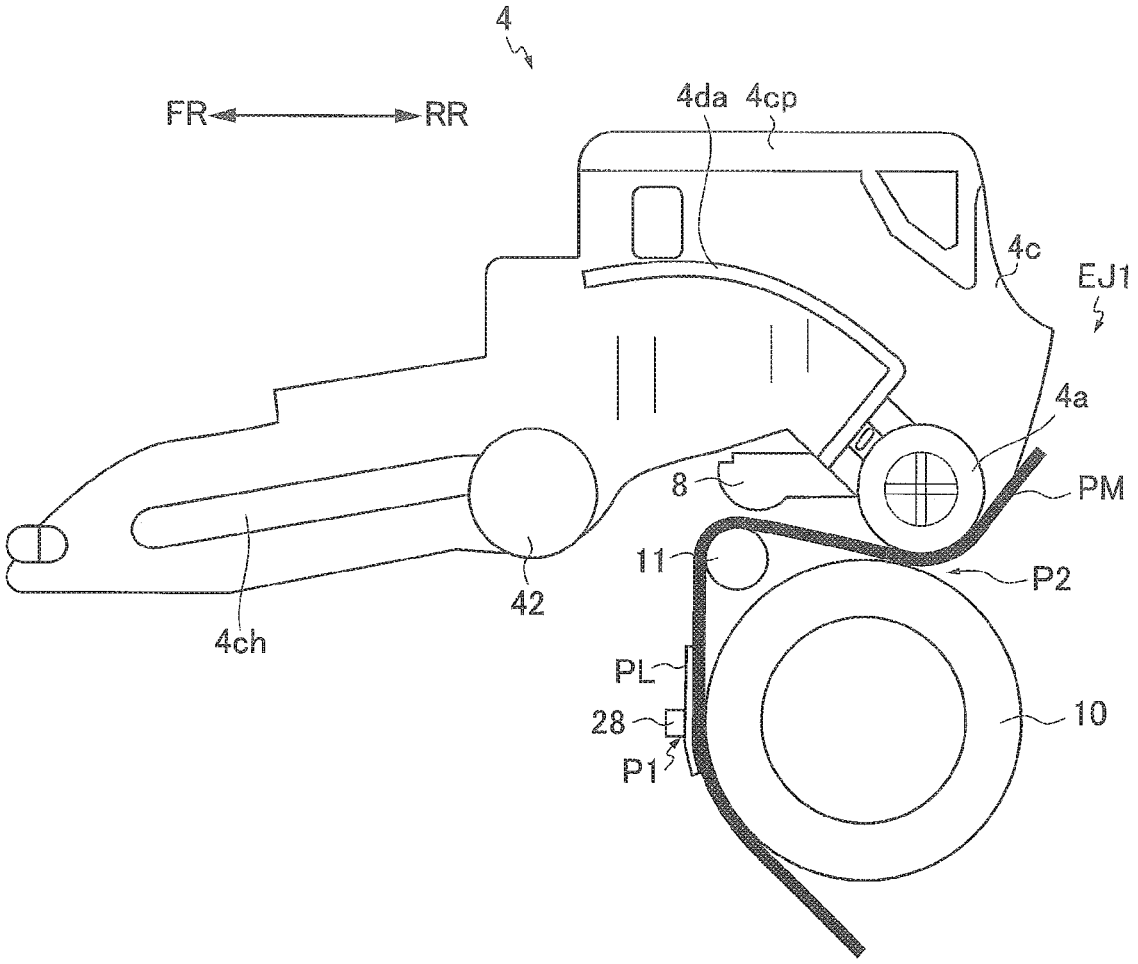
FIG. 23 is an explanatory view of an action of the pair of pressing parts of FIG. 6.

An action of the pair of pressing parts will be described below. FIGS. 21 to 23 each illustrates an explanatory view of an action of the pair of pressing parts of FIG. 6.

As shown in FIG. 21, the mount PM comes loose in a space between the separation roller 4*a* and the platen roller 10, when the separation unit 4 is at a position shown in FIG. 18.

As shown in FIG. 22, the rear end of the separation unit 4 swings downward when the separation unit 4 swings from the continuous ejection position to the separation ejection position as shown in FIG. 19. At this time, a lower portion of the rib 8*a* comes in contact with an upper face (a label attachment face) of the loose mount PM and presses the mount PM downward (namely, a direction toward the platen roller 10 and the separation pin 11).

As described above, when (or while) the separation roller 4*a* moves from the continuous ejection position to the separation ejection position, the pair of pressing parts 8 is configured to press the mount PM toward the separation pin 11 between a first feed position P1 and a second feed position P2. That is, the pair of pressing parts 8 is configured to press the mount PM so that a gap between the platen roller 10 and the mount PM becomes shorter. The mount PM is pinched between the thermal head 28 and the platen roller 10 at the first feed position P1 where the thermal head 28 and the platen roller 10 are opposed. Thus, as the separation roller 4*a* moves, the mount PM is pushed out by the pair of pressing parts 8 to a direction toward an outlet EJ1 (namely, to the rear side RR).

As shown in FIG. 23, the mount PM, which has been pushed out by the pair of pressing parts 8, is pinched between the separation roller 4*a* and the platen roller 10, when the separation unit 4 is set at the separation ejection position as illustrated in FIG. 20. That is, the separation ejection position is a positon where the separation roller 4*a* and the platen roller 10 are opposed.

Now that the mount PM is pushed out to a direction toward an outlet EJ1, the mount PM winds around the separation pin 11. In the separation ejection mode, the separation pin 11 separates a feeding path of the mount PM and a feeding path of the label PL between the first feed position P1 and the second feed position P2. That is, when the separation roller 4*a* is at the separation ejection position, the label PL can be separated from the mount PM. At this time, the separation pin 11 supports a back face of the mount PM between the first feed position P1 and the second feed position P2. Thereby, the mount PM is prevented from being loose between the first feed position P1 and the second feed position P2.

As described above, the pair of pressing parts 8 functions as a looseness prevention mechanism that prevents the mount PM from being loose between the first feed position P1 and the second feed position P2.

When the separation unit 4 is set at the separation ejection position, the pair of pressing parts 8 does not contact the mount PM that is fed by the platen roller 10. Thus, the pair of pressing parts 8 does not disturb feeding of the mount PM. Thereby, the mount PM can be fed smoothly.

(6) CONTINUOUS EJECTION MODE AND SEPARATION EJECTION MODE

Figure 24:
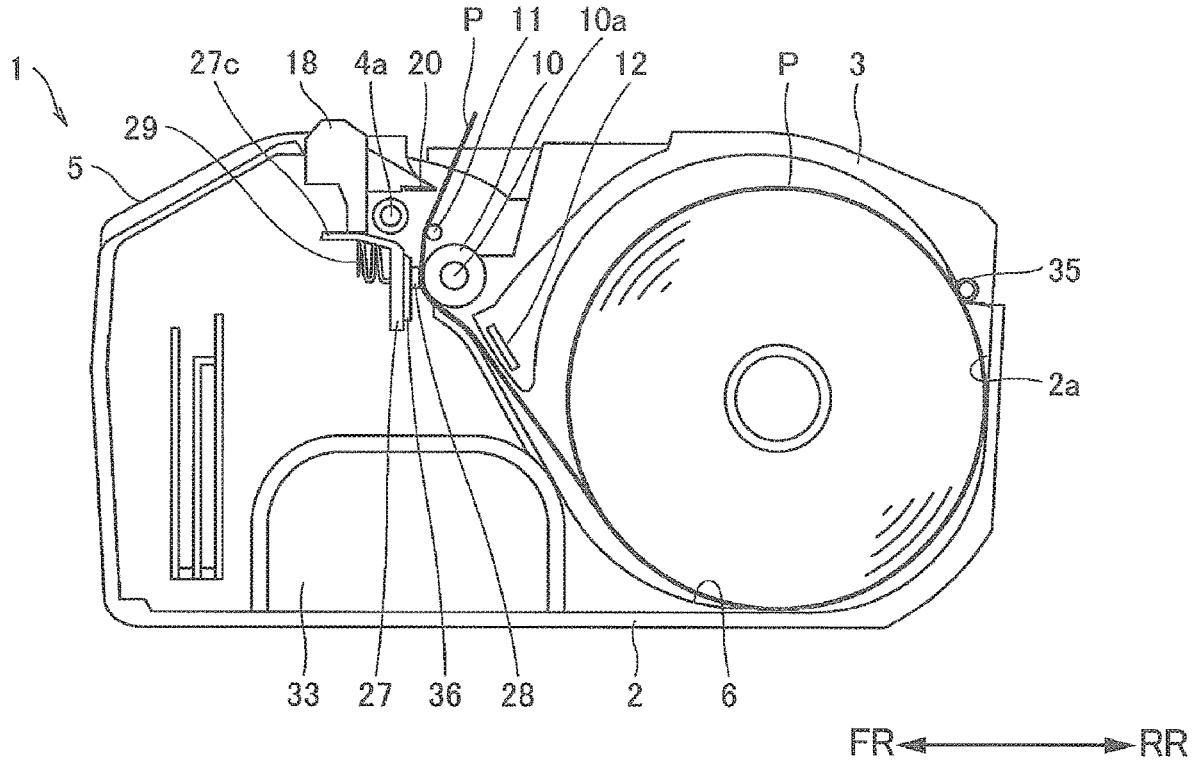
FIG. 24 is a schematic section view of the printer of the present embodiment in the continuous ejection mode.
Figure 25:
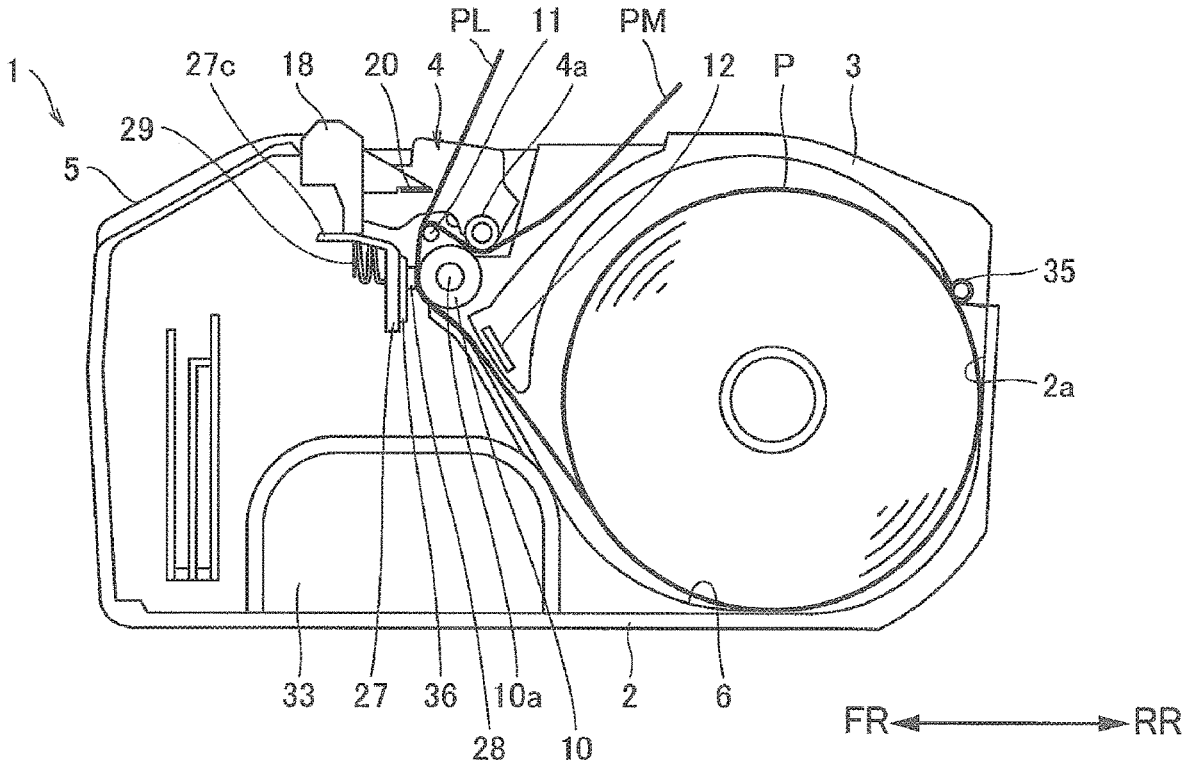
FIG. 25 is a schematic section view of the printer of the present embodiment in the separation ejection mode.
Figure 26:
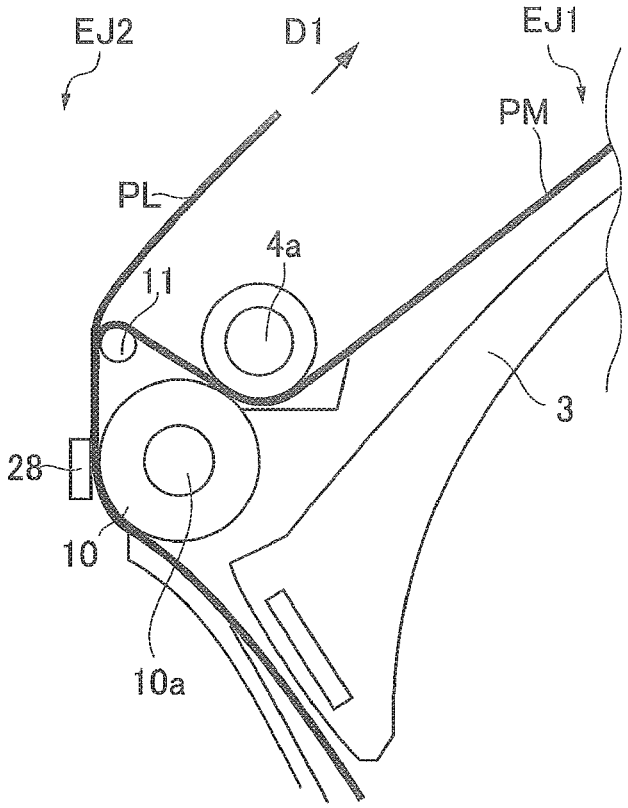
FIG. 26 is an enlarged view of the vicinity of the separation roller in a case in which the pair of the pressing parts of the present embodiment is not provided.
Figure 27:
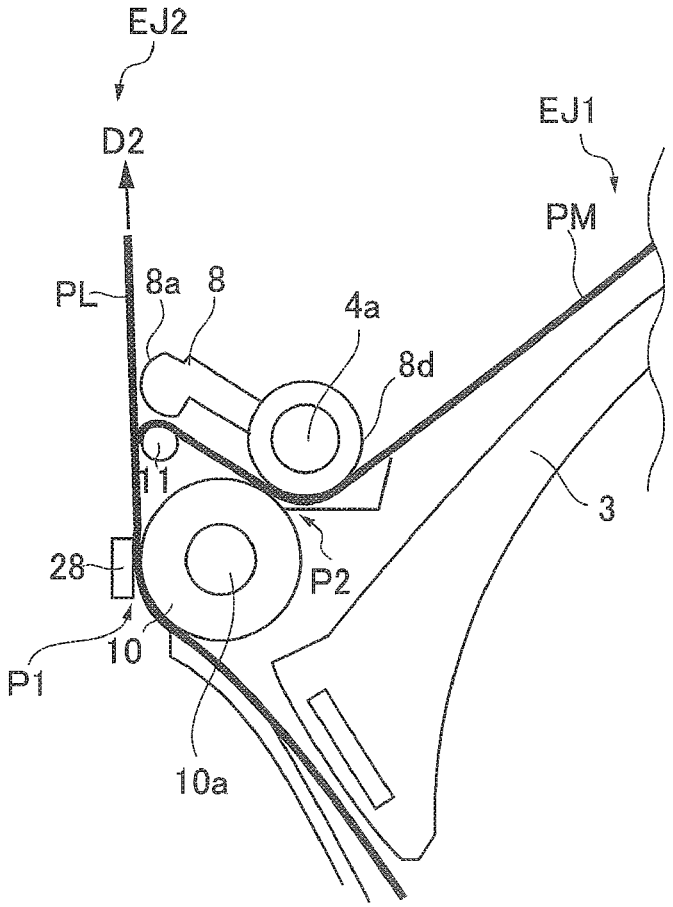
FIG. 27 is an enlarged view of the vicinity of the separation roller in the separation ejection mode of the present embodiment.

The continuous ejection mode and the separation ejection mode will be described below. FIG. 24 is a schematic section view of the printer of the present embodiment in the continuous ejection mode. FIG. 25 is a schematic section view of the printer of the present embodiment in the separation ejection mode. FIG. 26 is an enlarged view of the vicinity of the separation roller in a case in which the pair of the pressing parts of the present embodiment is not provided. FIG. 27 is an enlarged view of the vicinity of the separation roller in the separation ejection mode of the present embodiment.

In both of the continuous ejection mode and the separation ejection mode, at the printing step for printing the labels PL, while the continuous paper P extracted from the paper container 6 is pinched between the thermal head 28 and the platen roller 10, the platen roller 10 is rotated to feed the continuous paper P. During the feeding, print timing is determined based on the detection result obtained by the sensors 12*a*. Print signals are then transmitted to the thermal head 28 at the determined print timing. The print signals correspond to the print information. Heat of the heater resistors of the thermal head 28 is selectively generated in accordance with the print signals, thereby printing desired information on the labels PL.

In the case of the continuous ejection, as illustrated in FIG. 24, the separation unit 4 is located at the continuous ejection position inside of the printer 1. The printed label PL is then ejected without being separated from the mount PM. In the case of the continuous ejection, the mount PM with a required number of label(s) PL attached thereon is cut off with the cutter 20. Then, the user brings this cut-off mount PM to the site and separates the label(s) PL from the mount PM for attachment at the site. Therefore, the continuous ejection mode is suitable for the case where a target for attachment of the label PL is away from the printer 1.

As illustrated in FIG. 24, when the separation unit 4 is set at the continuous ejection position, the separation roller 4*a* is stored inside of the body case 2. Thus, the separation roller 4*a* does not stick out from the body case 2, which prevents the hands of the operator from coming into contact with the separation roller 4*a*. Therefore, deterioration of the separation roller 4*a* can be prevented.

Meanwhile, as shown in FIG. 25, the separation unit 4 is set at the separation ejection position in the separation ejection mode. The mount PM is pinched between the separation roller 4*a* of the separation unit 4 and the platen roller 10 via the separation pin 11. Thereby, when the platen roller 10 is rotated, the mount PM is fed while being pinched between the separation roller 4*a* and the platen roller 10. A feeding path of the printed labels PL is separated from the feeding path of the mount PM at the separation pin 11. That is, the printed labels PL are separated from the mount PM one by one, and are ejected from the printer 1. Because the labels PL are ejected one by one in the case of the separation ejection, the separation ejection is suitable for the case where a target for attachment of the labels PL is located near the printer 1.

As illustrated in FIG. 26, if the pair of pressing parts 8 was not provided in the printer 1 of the present embodiment, the label PL separated from the mount PM would be weighed down by its own weight and fed in a first direction D1. In other words, the feeding direction of the label PL is the first direction D1 at the downstream side from the platen roller 10. Because the paper roll R is curled in a curl direction, the labels PL temporarily attaching to the mount PM are also curled in that curl direction. Thus, the label PL would be weighed down further. If an adhesive portion of the label PL came in contact with a portion of the printer 1 (for example, a portion of the body case 2), the label PL would stick to the printer 1 and an operator would therefore need to separate the label PL from the printer 1.

In contrast, as shown in FIG. 27, the printer 1 of the present embodiment is provided with the pair of pressing parts 8. When the separation roller 4*a* is at the separation ejection position, the pair of pressing parts 8 is located on the adhesive portion side of the label PL separated from the mount PM. Even if the separated label PL is weighed down by its own weight toward the separation roller 4*a* and the separation pin 11, the pair of pressing parts 8 supports the adhesive portion of the label PL above the platen roller 10 and the separation pin 11. Thereby, the label PL is fed in a second direction D2 that is different from the first direction D1. The second direction D2 is a direction substantially orthogonal to a horizontal plane (namely, upper direction) when the printer 1 is located on the horizontal plane. Thereby, in a case where the printer 1 is used with a shoulder belt hanged on the shoulder of the operator (that is, the printer 1 is used so as to place the outlet EJ2 laterally (in a horizontal direction), the ejected label PL is prevented from being weighed down. Thus, it can be prevented that the separated label PL from the mount PM sticks to the printer 1. Consequently, an operator's work in removing the ejected label PL from the printer 1 becomes efficient.

Contact area of the adhesive portion of the label PL and the rib 8*a* is relatively small. Thus, even if the label PL sticks to the rib 8*a*, the operator can remove the label PL from the rib 8*a* easily.

When the separation roller 4*a* is at the separation ejection position and the platen roller 10 feeds the mount PM, the rib 8*a* is configured not to contact the mount PM. In other words, the mount PM fed by the platen roller 10 does not contact the rib 8*a*. Thus, the rib 8*a* does not disturb the feeding of the mount PM, thereby allowing the mount PM to be fed smoothly.

Each of the pair of pressing parts 8 is provided with the projection 8*d*. The operator pushes the mount PM, from which the label PL is separated, to the projection 8*d*, and can cut the mount PM easily.

As described above, the separation roller 4*a* is set at the separation ejection position in the separation ejection mode, and is set at the continuous ejection position in the continuous ejection mode. The separation roller 4*a* can move between the continuous ejection position and the separation ejection position together with the separation unit 4.

When the separation roller 4*a* is set at the separation ejection position, the separation roller 4*a* faces and is driven by the platen roller 10 while coming in contact with the mount PM at the second feed position P2 on the feeding path of the mount PM. In other words, when the separation roller 4*a* is set at the separation ejection position, the separation roller 4*a* is opposed to the platen roller 10. Further, when the separation roller 4*a* is set at the separation ejection position, the separation roller 4*a* is driven by the platen roller 10 while coming in contact with a face of the mount PM (an upper face of the mount PM in FIG. 27) between a location where the separation pin 11 contacts the back face of the mount PM (a lower face of the mount PM in FIG. 27) and the outlet EJ1 of the mount PM (the outlet EJ1 provided to the rear side RR with respect to the first feed position P1 where the thermal head 28 and the platen roller 10 are opposed), in the feeding path of the mount PM.

(7) MODIFICATION EXAMPLES

Modification examples of the present embodiment will be described below.

(7-1) First Modification Example

A first modification example of the present embodiment will be described below. The first modification example is a modification example of a shape of the pair of pressing parts.

Figure 28:
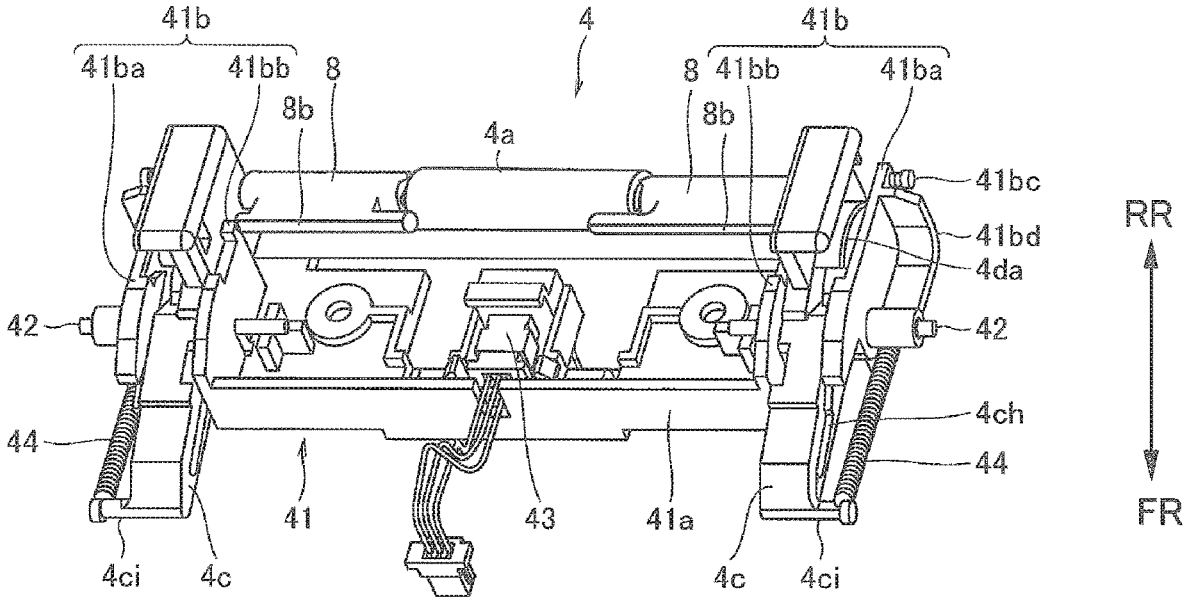
FIG. 28 is a perspective view showing the separation unit and the support board at the continuous ejection position according to the first modification example.
Figure 29:
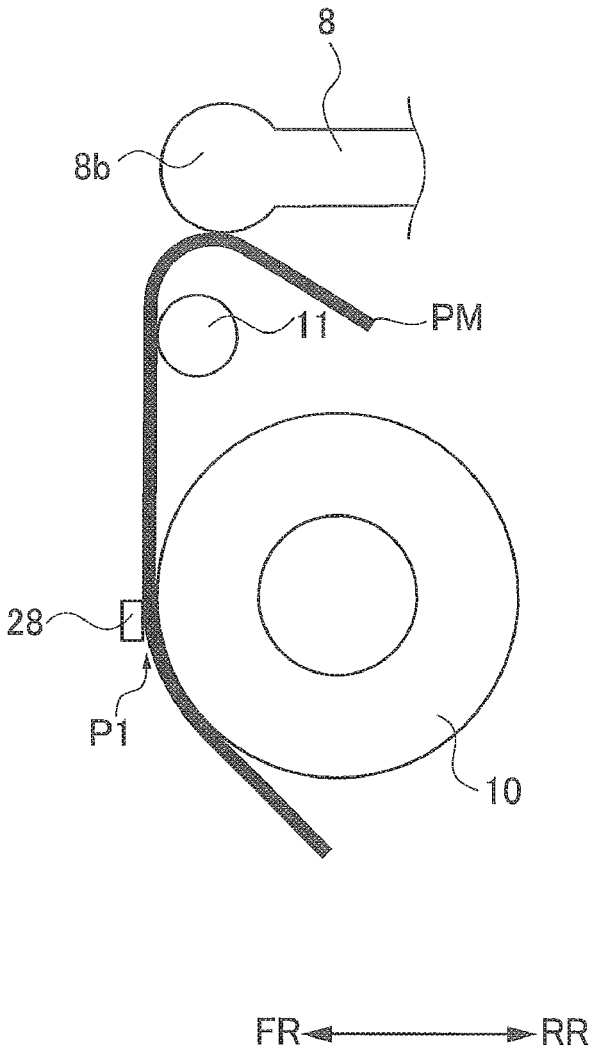
FIG. 29 is an enlarged view of the vicinity of the separation roller of a first example according to the first modification example.
Figure 30:
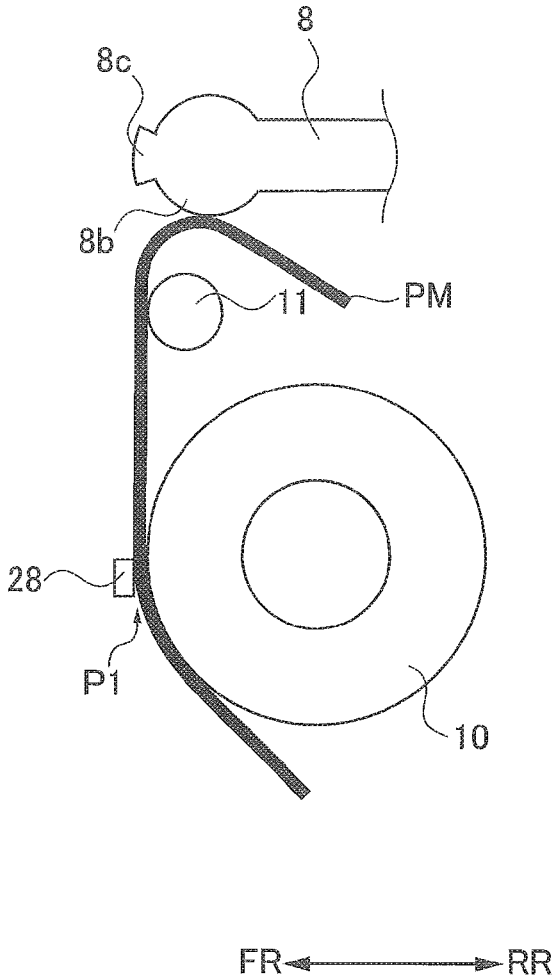
FIG. 30 is an enlarged view of the vicinity of the separation roller of a second example according to the first modification example.

FIG. 28 is a perspective view showing the separation unit and the support board at the continuous ejection position according to the first modification example. FIG. 29 is an enlarged view of the vicinity of the separation roller of a first example according to the first modification example. FIG. 30 is an enlarged view of the vicinity of the separation roller of a second example according to the first modification example.

As shown in FIGS. 28 and 29, a protrusion 8*b* is provided at the front end of each of the pair of pressing parts 8.

When the separation unit 4 moves from the continuous ejection position to the separation ejection position as shown in FIG. 19, a lower portion of the protrusion 8*b* comes in contact with the loose mount PM, and presses the mount PM downward (namely, a direction toward the platen roller 10 and the separation pin 11) such that a gap between the platen roller 10 and the mount PM becomes small, in the same manner as the rib 8*a*. Thereby, as shown in FIG. 29, the mount PM is prevented from being loose between the first feed position P1, at which the thermal head 28 and the platen roller 10 are opposed, and the second feed position P2 (not illustrated in FIG. 29), at which the separation roller 4*a* and the platen roller 10 are opposed.

When the separation unit 4 is set at the separation ejection position as shown in FIG. 20, the protrusion 8*b*, in the same manner as the rib 8*a*, supports the adhesive portion of the label PL, which is separated from the mount PM, above the platen roller 10 and the mount PM. Thereby, the ejected label PL is prevented from being weighed down.

As shown in FIG. 30, a first rib 8*c* may be provided at the front end of the protrusion 8*b*. The first rib 8*c* is configured to support the adhesive portion of the label PL separated from the mount PM in the separation ejection mode.

A second rib that is different from the first rib 8*c* may be provided at a lower portion of the protrusion 8*b*. The second rib protrudes downward from the lower portion of the protrusion 8*b*. In this case, the second rib comes in contact with the loose mount PM, and presses the mount PM downward such that a gap between the platen roller 10 and the mount PM becomes small, in the same manner as the rib 8*a*.

(7-2) Second Modification Example

Figure 31:
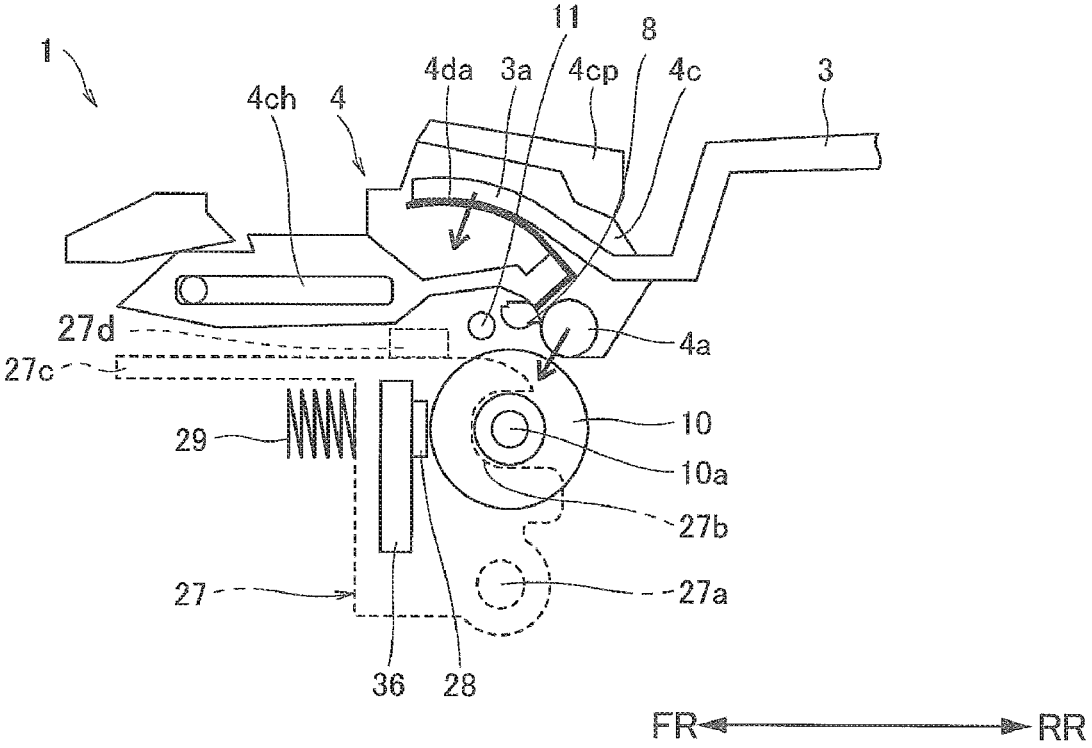
FIG. 31 is an enlarged view of the major components in FIG. 9 for explaining an action of the spacer according to the second modification example.

A second modification example of the present embodiment will be described below. The second modification example prevents looseness of the mount in space at the front side of the platen roller 10 and the separation pin 11 (namely, space between the first feed position P1 and the second feed position P2). FIG. 31 is an enlarged view of the major components in FIG. 9 for explaining an action of the spacer according to the second modification example.

As shown in FIG. 31, a spacer 27*d* (an example of a print medium restriction part) is provided on the upper portion of the head bracket 27. When the separation unit 4 is set at the separation ejection position, the spacer 27*d* is located on the opposite side of the separation roller 4*a* with respect to the separation pin 11 (namely, the front side FR of the separation roller 4*a* and the separation pin 11) in a lateral direction.

As shown in FIGS. 21 to 23, when the position of the separation unit 4 is set at the separation ejection position from the continuous ejection position, the spacer 27*d* restricts entering of the label PL and the mount PM into space on the front side FR of the platen roller 10 and the separation pin 11 (that is, space between the first feed position P1 and the separation pin 11). Thereby, the label PL and the mount PM can be prevented from entering into space on the front side FR of the platen roller 10 and the separation pin 11. Consequently, the mount PM to which the label PL temporarily adheres is prevented from being loose.

(8) OTHER MODIFICATION EXAMPLES

An example has been described with reference to FIG. 27 in which a feeding direction of the label PL (the second direction D2) coincides with the upper direction. Nevertheless, the other direction may be applied as the second direction D2. Any direction may be applied as the second direction D2 so long as such direction is away from the separation roller 4*a* with respect to the first direction D1 (namely, a direction inclined toward the front side FR of the printer 1).

In the aforementioned embodiment, an example has been explained, as shown in FIG. 18, in which the separation unit 4 swings to the second rotation direction in response to engagement of the front end of the cover 3 with the front end of the separation unit 4. Nevertheless, the present embodiment may be applied to a case in which the front end of the cover 3 does not engage with the front end of the separation unit 4. In this case, in order to set the separation unit 4 at the separation ejection position, a user closes the cover 3 and then sets the separation unit 4 at the separation ejection position manually.

In the aforementioned embodiment, the continuous ejection position, the swing end position, and the slide end position have been referred to as an example of a second position. Nevertheless, other position may be applied as the second position. The second position may be any position that is different from the separation ejection position in a range where the separation unit 4 moves (namely, swings and/or slides). A position other than the continuous ejection position, the swing end position, and the slide end position, may be applied as the second position.

The present invention is not limited to the embodiment that has been described above in details. The embodiment described above may be improved or revised in a variety of ways in such a manner that does not depart from the spirit of the present invention. The embodiment and the modification examples described above may be combined as appropriate.

1: Printer
2: Body case
2*a*: Opening,
3: Cover
3*a*: Pair of pressing parts
4: Separation unit
4*a*: Separation roller
4*b*: Shaft
4*c*: Pair of supporters
4*ch*: Guide rail hole
4*ci*: Attachment protrusion
4*cj*: First claw
4*ck*: Second claw
4*cp*: Eave
4*da*: Pair of plate springs
4*e*: Screws
5: Front cover
6: Paper container
6*a*: Paper guide
7: Battery cover
8: Pair of pressing parts
8*a*, 8*c*: Rib
8*b*: Protrusion
8*d*: Projection
10: Platen roller
10*b*: Platen shaft
10*a*: Gear
11: Separation pin
12 (12*a*, 12*b*): Sensor
15: Display unit
16*a*, 16*b*: Operation button
17: Power-supply button
18: Cover-open button
19: Pair of release levers
20: Cutter
26: Printing unit
27: Head bracket
27*a*: Rotating shaft
27*b*: Groove
27*c*: Pressing part
27*d*: Spacer
28: Thermal head
29: Coil spring
33: Battery container
35: Torsion spring
36: Circuit board
41: Support board
41*a*: Base
41*b*: Pair of unit attachment parts
41*ba*: First attachment piece
41*bb*: Second attachment piece
41*bc*: Attachment protrusion
41*bd*: Guide eave
41*be*: First protrusion
41*bf*: Second protrusion
42: Shaft
43: Separation sensor
44: Coil spring
45: Guide surface
46: First stopper

47: Restriction surface

48: Second stopper

The invention claimed is:

1. A printer capable of separating a print medium from a mount and ejecting the print medium, the printer comprising:

a platen roller configured to feed, along a feeding path, a mount to which a print medium temporarily adheres;

a print head configured to print on the print medium, the print head being opposed to the platen roller;

a driven roller that is movable between a first position and a second position different from the first position, the first position being a position where the driven roller is opposed to the platen roller, the driven roller configured to be driven by the platen roller while coming in contact with the mount, when the driven roller is at the first position;

a shaft configured to rotatably support the driven roller;

a separation member configured to separate a feeding path of the mount and a feeding path of the print medium; and a looseness prevention mechanism configured to prevent the mount from being loose between a first feed position and a second feed position when the driven roller moves from the second position to the first position, the first feed position being a position on the feeding path where the platen roller and the print head are opposed, the second feed position being a position on the feeding path where the platen roller and the driven roller are opposed, wherein the looseness prevention mechanism includes a pressing part provided at the shaft and projecting therefrom, the pressing part configured to:

(i) press the mount toward the separation member between the first feed position and the second feed position, when the driven roller moves from the second position to the first position, and (ii) support an adhesive portion of the print medium separated from the mount and not contact the mount, when the driven roller is at the first position and the platen roller feeds the mount.

2. The printer according to claim 1, wherein the looseness prevention mechanism is configured to prevent the mount from being loose between the separation member and the driven roller.

3. The printer according to claim 2, further comprising:

a cover that is swingable between an open position and a closed position, and a separation unit including the driven roller, the shaft, and a pair of plate springs, the separation unit being swingable between the first position and the second position, wherein an end of the cover comes into contact with the pair of plate springs at the second position, when the cover is at the closed position.

4. The printer according to claim 2, further comprising:

a cover that is swingable between an open position and a closed position, and a separation unit including the driven roller, the separation unit being swingable between the first position and the second position, wherein a portion of the cover engages with a portion of the separation unit at the second position, when the cover swings from the open position to the closed position.

5. The printer according to claim 1, wherein the looseness prevention mechanism is configured to move toward the separation member to prevent the mount from being loose while coming in contact with the mount, when the driven roller moves from the second position to the first position.

6. The printer according to claim 5, further comprising:

a cover that is swingable between an open position and a closed position, and a separation unit including the driven roller, the shaft, and a pair of plate springs, the separation unit being swingable between the first position and the second position, wherein an end of the cover comes into contact with the pair of plate springs at the second position, when the cover is at the closed position.

7. The printer according to claim 5, further comprising:

a cover that is swingable between an open position and a closed position, and a separation unit including the driven roller, the separation unit being swingable between the first position and the second position, wherein a portion of the cover engages with a portion of the separation unit at the second position, when the cover swings from the open position to the closed position.

8. The printer according to claim 1, further comprising:

a cover that is swingable between an open position and a closed position, and a separation unit including the driven roller, the shaft, and a pair of plate springs, the separation unit being swingable between the first position and the second position, wherein an end of the cover comes into contact with the pair of plate springs at the second position, when the cover is at the closed position.

9. The printer according to claim 8, further comprising a body case to which the cover is openably and closably attached, wherein the platen roller is attached to the cover, and the print head is provided in the body case, and is opposed to the platen roller when the cover is closed.

10. The printer according to claim 1, further comprising:

a cover that is swingable between an open position and a closed position, and a separation unit including the driven roller, the shaft, and a pair of plate springs, the separation unit being swingable between the first position and the second position, wherein a portion of the cover comes into contact with the pair of plate springs at the second position, when the cover is at the closed position.

11. The printer according to claim 1, further comprising:

a cover that is swingable between an open position and a closed position, and a separation unit including the driven roller and the pressing part, wherein the driven roller engages with the cover when the cover is in the closed position.

12. The printer according to claim 1, wherein the pressing part includes a rib that supports the adhesive portion of the print medium.

13. The printer according to claim 1, further comprising a print medium restriction part configured to restrict the print medium from becoming loose between the first feed position and the separation member, when the print medium is pinched between the platen roller and the print head.

14. The printer according to claim 1, wherein the pressing part includes a first pressing part and a second pressing part, and wherein the first pressing part and the second pressing part are located on opposite ends of the driven roller along the shaft.

15. A printer capable of separating a print medium from a mount and ejecting the print medium, the printer comprising:

a platen roller configured to feed, along a feeding path, a mount to which a print medium temporarily adheres;

a print head configured to print on the print medium, the print head being opposed to the platen roller;

a driven roller that is movable between a first position and a second position different from the first position, the first position being a position where the driven roller is opposed to the platen roller, the driven roller configured to be driven by the platen roller while coming in contact with the mount, when the driven roller is at the first position;

a shaft configured to rotatably support the driven roller;

a separation member configured to separate a feeding path of the mount and a feeding path of the print medium;

a looseness prevention mechanism configured to prevent the mount from being loose between a first feed position and a second feed position when the driven roller moves from the second position to the first position, the first feed position being a position on the feeding path where the platen roller and the print head are opposed, the second feed position being a position on the feeding path where the platen roller and the driven roller are opposed;

a cover that is swingable between an open position and a closed position; and a separation unit including the driven roller, the separation unit being swingable between the first position and the second position, wherein the looseness prevention mechanism includes a pressing part provided at the shaft and projecting therefrom, the pressing part configured to:

(i) press the mount toward the separation member between the first feed position and the second feed position, when the driven roller moves from the second position to the first position, and (ii) support an adhesive portion of the print medium separated from the mount, when the driven roller is at the first position, and wherein a portion of the cover engages with a portion of the separation unit at the second position, when the cover swings from the open position to the closed position.

16. The printer according to claim 15, wherein the pressing part includes a first pressing part and a second pressing part, and wherein the first pressing part and the second pressing part are located on opposite ends of the driven roller along the shaft.

* * * * *